US008252499B2

(12) United States Patent
Kurimoto et al.

(10) Patent No.: US 8,252,499 B2
(45) Date of Patent: Aug. 28, 2012

(54) IMAGE FORMING METHOD AND IMAGE FORMING APPARATUS

(75) Inventors: Eiji Kurimoto, Numazu (JP); Keisuke Shimoyama, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/014,337

(22) Filed: Jan. 26, 2011

(65) Prior Publication Data

US 2011/0183255 A1 Jul. 28, 2011

Related U.S. Application Data

(62) Division of application No. 12/036,779, filed on Feb. 25, 2008, now abandoned.

(30) Foreign Application Priority Data

Mar. 6, 2007 (JP) ..... 2007-055088

(51) Int. Cl.
*G03G 5/05* (2006.01)

(52) U.S. Cl. ..... 430/133

(58) Field of Classification Search ..... 430/127, 430/133, 135

See application file for complete search history.

(56) References Cited

U.S. PATENT DOCUMENTS

| | | | |
|---|---|---|---|
| 5,047,803 | A | 9/1991 | Kanoto |
| 5,578,405 | A | 11/1996 | Ikegami et al. |
| 5,702,855 | A | 12/1997 | Ikegami et al. |
| 6,124,067 | A | 9/2000 | Mikuriya et al. |
| 6,300,029 | B1 | 10/2001 | Rokutanzono |
| 6,432,596 | B2 | 8/2002 | Ikuno et al. |
| 6,936,388 | B2 | 8/2005 | Suzuki et al. |
| 7,160,658 | B2 | 1/2007 | Suzuki et al. |
| 7,267,916 | B2 | 9/2007 | Sugino et al. |
| 7,274,898 | B2 | 9/2007 | Nousho et al. |
| 7,314,693 | B2 | 1/2008 | Ikegami et al. |
| 2002/0051654 | A1 | 5/2002 | Niimi et al. |
| 2003/0134220 | A1 | 7/2003 | Emoto et al. |
| 2005/0058918 | A1 | 3/2005 | Kurimoto et al. |
| 2006/0051688 | A1 | 3/2006 | Toda et al. |
| 2006/0222979 | A1 | 10/2006 | Ishida et al. |
| 2007/0219375 | A1 | 9/2007 | Fujiyama et al. |
| 2007/0248901 | A1 | 10/2007 | Shimoyama et al. |
| 2007/0264047 | A1 | 11/2007 | Kurimoto et al. |

FOREIGN PATENT DOCUMENTS

| | | |
|---|---|---|
| JP | 6-313972 | 11/1994 |
| JP | 7-13374 | 1/1995 |
| JP | 7-43920 | 2/1995 |
| JP | 7-44065 | 2/1995 |
| JP | 7-92701 | 4/1995 |
| JP | 8-22136 | 1/1996 |
| JP | 8-146639 | 6/1996 |
| JP | 8-152721 | 6/1996 |
| JP | 9-211876 | 8/1997 |
| JP | 9-258469 | 10/1997 |
| JP | 10-69104 | 3/1998 |
| JP | 10-73942 | 3/1998 |
| JP | 10-115946 | 5/1998 |
| JP | 10-123802 | 5/1998 |
| JP | 10-123855 | 5/1998 |
| JP | 10-123856 | 5/1998 |
| JP | 10-177261 | 6/1998 |
| JP | 10-177262 | 6/1998 |
| JP | 10-177263 | 6/1998 |
| JP | 10-177264 | 6/1998 |
| JP | 10-177269 | 6/1998 |
| JP | 10-186696 | 7/1998 |
| JP | 10-246997 | 9/1998 |

(Continued)

*Primary Examiner* — Janis L Dote

(74) *Attorney, Agent, or Firm* — Oblon, Spivak, McClelland, Maier & Neustadt, L.L.P.

(57) ABSTRACT

A high-quality, stable image forming apparatus and method which are free from abnormal images, particularly afterimages, after prolonged repeated use by using a photoconductor a conductive substrate and a single-layered photosensitive layer which contains a charge generating material, an electron transporting material, a positive-hole transporting substance and a binder resin, wherein the charge generating material contains crystalline titanyl phthalocyanine having a maximum diffraction peak of at least 27.2° as a diffraction peak ±0.2° of the Bragg angle 2θ with respect to the Cu-Kα line of the wavelength of 1.542Å, further having major peaks at 9.4°, 9.6°, 24.0°, and also having a peak at 7.3° as a diffraction peak on the lowest angle side but not having a peak between the peak of 7.3° and that of 9.4°, and X-metal free phthalocyanine, and the electron transporting material contains a compound represented by the following General Formula (1), General Formula (1)

10 Claims, 9 Drawing Sheets

FOREIGN PATENT DOCUMENTS

| | | |
|---|---|---|
| JP | 11-133825 | 5/1999 |
| JP | 11-184127 | 7/1999 |
| JP | 11-184135 | 7/1999 |
| JP | 2000-75521 | 3/2000 |
| JP | 2000-105478 | 4/2000 |
| JP | 2000-112162 | 4/2000 |
| JP | 2000-147803 | 5/2000 |
| JP | 2000-231246 | 8/2000 |
| JP | 2000-292946 | 10/2000 |
| JP | 2001-19871 | 1/2001 |
| JP | 2001-51438 | 2/2001 |
| JP | 2001-117244 | 4/2001 |
| JP | 2001-235889 | 8/2001 |
| JP | 2001-305762 | 11/2001 |
| JP | 2001-305763 | 11/2001 |
| JP | 2002-6528 | 1/2002 |
| JP | 2002-107972 | 4/2002 |
| JP | 2002-107983 | 4/2002 |
| JP | 2002-123067 | 4/2002 |
| JP | 2004-45991 | 2/2004 |
| JP | 3566980 | 6/2004 |
| JP | 3727119 | 10/2005 |
| WO | WO 2005/092901 A1 | 10/2005 |

IMAGE FORMING METHOD AND IMAGE FORMING APPARATUS

CROSS REFERENCE TO RELATED APPLICATIONS

The present application is a Divisional of U.S. application Ser. No. 12/036,779, filed Feb. 25, 2008, now abandoned, the entire contents of which are hereby incorporated by reference. The present application also claims priority to Japanese patent application JP 2007-055088, filed Mar. 6, 2007.

BACKGROUND OF THE INVENTION

1. Field of the Invention

The present invention relates to an image forming apparatus and an image forming method suitable for copiers, facsimile machines, laser printers, direct digital plate makers and the like.

2. Description of the Related Art

Electrophotographic photoconductors (hereinafter sometimes referred to as "photoconductor," "latent electrostatic image bearing member" or "image bearing member") for use in an electrophotographic image forming apparatus applicable to copiers and laser printers and the like were predominantly inorganic photoconductors made of such material as selenium, zinc oxide or cadmium sulfide. However, organic photoconductors (OPC) that are more advantageous over such inorganic photoconductors have now found many applications in view of their reduced loads on the global environment, reduced costs, and increased flexibility in design.

These organic photoconductors are broadly categorized into two types: single layer photoconductors in which at least a charge generating material, an electron transporting material and a binder resin are contained in a photosensitive layer composed of a single layer on an electric-conductive substrate; and stacked layer photoconductors prepared by stacking a charge generating layer mainly composed of a charge generating material and a charge transporting layer mainly composed of a charge transporting material.

In recent years, in view of a greater degree of freedom in design, separated-function stacked layer photoconductors have been used in a higher proportion. However, these photoconductors have been now thought to be unsuitable in forming a high-quality image because of poor productivity resulting from many coating steps and a problem in which charge occurrence in a charge generating layer moves into a charge transporting layer, during which the charge is dispersed to decrease the resolution dot density.

On the other hand, manufacture of a single layer photoconductor requires fewer coating steps and film deposition steps because of its simple layer configuration and therefore excellent in productivity. In addition, since a charge generating material is dispersed into a photosensitive layer, charge can be generated in the vicinity of the surface layer and dispersed to a lower extent, which is advantageous in realizing a higher resolution dot density. Further, these photoconductors are smaller in sensitivity variation resulting from friction. With these facts taken into account, the single layer photoconductors are favorably constituted in obtaining an image forming apparatus for realizing a stable and high-quality image, which is a major demand as an image forming apparatus nowadays.

However, due to a fact that a high quality image is realized by using the photoconductors constituted with such a single layer, there is often reported a case where in an image forming apparatus for forming images at a high density, image degradation, or "afterimage," is found as a side effect when the apparatus is repeatedly used. It is, therefore, impossible to obtain a high-quality image output stably for a prolonged period of time as now demanded.

Here, an explanation will be made for the phenomenon of afterimages. In an image forming apparatus based on an electrophotographic process, for example, when a half-tone image is printed out after an image distinctly different in brightness, as shown in FIG. 1, there is a case where a printed-out image pattern may stand out before the half-tone image in an image at which the half-tone image should otherwise form a uniform image. FIG. 2 shows the pattern diagram thereof. This image degradation is called "positive afterimage" or "positive ghost." Particularly, in an image forming apparatus based on a high-quality full-color electrophotographic process, the image degradation must be avoided. On the contrary, an image degradation in which a previously printed image pattern is recognized thinly at a half-tone image portion is called "negative afterimage" or "negative ghost." In this case as well, the image degradation must be avoided. FIG. 3 shows the pattern diagram thereof.

The phenomenon of afterimages is thought to occur through several mechanisms, one of which is, for example, interpreted as occurrence due to variation in electric potential on the surface of photoconductor as described in Japanese Patent Application Laid-Open (JP-A) No. 11-133825. For explaining this interpretation, FIG. 4 graphically shows variation in electric potential on the surface of photoconductor at individual steps of latent image formation, development and post-transfer.

In this instance, upon formation of a latent image given in FIG. 4A, after the surface of the photoconductor is uniformly charged at −700V, image information is exposed (the arrow indicates exposed sites). An exposure portion is set to approximately 0V in electric potential. Then, at the time of development given in FIG. 4B, depending on a difference between the electric potential on development and the electric potential on the surface of the photoconductor, toner is coated on the surface of photoconductor to effect development. Then, at the time of transfer, printer paper is positively charged to transfer a toner image from the photoconductor to the print paper. As shown in FIG. 4C, the photoconductor is given a reverse bias by a transfer unit, and an electric potential on the surface of the photoconductor after transfer is, as a whole, shifted to a positively charged direction. An electric potential at the exposure portion exceeds 0V, and the polarity is finally reversed to result in a positive electric potential (which is indicated as +10V in the drawing). As a matter of course, the same principle is applicable to a case where the charged potential is opposite because a positive charge is switched to a negative charge or vice versa.

Upon repeated occurrence of this phenomenon, the surface electric potential of the photoconductor at a positively charged portion is accordingly charged positively in electric potential, even if the surface of photoconductor is uniformly charged negatively by using a charge unit before image exposure. As a result, a portion shifted to a positively charged direction is greater in difference in development potential than other portions, thereby an apparent intensification takes place to result in the formation of a thick toner image. This portion is identified as a positive afterimage.

As described in JP-A No. 2002-123067, for example, an afterimage will occur in a process in which an image density is processed depending on the presence or absence of dots (in a binary manner) as with a printing process widely used in an inkjet printer. Although to a minimal extent, illumination distribution is found at a beam spot into which a dot configuration is written. Therefore, upon radiation of the beam spot at a portion at which the charged electric potential is shifted positively, the surface electric potential is offset to a low electric potential, by which a developable dot border portion is expanded to result in an enlarged dot diameter.

Thus an excessively enlarged dot image is perceived to be thick when viewed as a whole image, also resulting in an image on which a positive afterimage is identified. In this instance, for example, an extent of the afterimage is perceived more intensively as an image is output at a higher resolution dot density of 1200 dpi in place of 600 dpi. Thus, this problem is further magnified when an image forming apparatus based on an electrophotographic process is made higher in resolution dot density.

A cause of the variation in surface electric potential of a photoconductor may be mainly derived from accumulation of a space charge inside a photosensitive layer as described, for example, in JP-A No. 10-177261. Therefore, in order to eliminate an afterimage, required is a unit for preventing the accumulation of a space charge.

Hereinafter, an explanation will be made for related arts of the prevention of afterimages.

(1) Improvement in Surface Layer of Photoconductor

For example, JP-A No. 10-115946 has made such a proposal that a polyallylate resin is contained in the surface layer of a photoconductor and also the dielectric constant is established to be 2.3 or more. The effect has been confirmed by referring to an example, although an explanation about a mechanism for realizing the effect is omitted due to the fact that the evaluation of the effect is in progress (paragraph number [0038]). A similar proposal is found in JP-A No. 11-184135 in which an azo pigment is contained in a photosensitive layer and a polyallylate resin is also contained in the surface layer of the photoconductor. According to this proposal, the polyallylate resin is highly crystalline, which is estimated to orient an electron transporting material to some extent due to the characteristics. The orientation may be combined with a specific charge generating material (azo pigment) to lower the barrier of an injection boundary surface, thus resulting in decrease in photo memory (paragraph number [0036]).

Further, JP-A No. 10-177263 has made such a proposal that in an image forming apparatus based on electrophotographic process and equipped with an intermediate transfer member, bisphenol polycarbonate is contained in the surface layer of a stacked-layer-structure electrophotographic photoconductor with a charge generating layer containing a phthalocyanine compound. The effect has been confirmed by referring to examples, although no explanation is made for a mechanism for providing the effect. The effect is thought to be derived from a material selected.

Further, JP-A No. 10-177264 has made such a proposal that in an image forming apparatus based on the electrophotographic process and equipped with an intermediate transfer member, an electron transporting material made up of macromolecular polymers is contained in the surface layer of a stacked-layer-structure electrophotographic photoconductor with a charge generating layer containing a phthalocyanine compound. The effect has been confirmed by referring to examples, although no explanation is made for a mechanism for providing the effect. The effect is thought to be derived from a material selected.

Further, JP-A No. 10-177269 has made such a proposal that in an image forming apparatus based on the electrophotographic process and equipped with an intermediate transfer member, a surface protective layer, which is either insulative or semi-electric conductive due to the content of a resistance adjusting material, is installed on a stacked-layer-structure electrophotographic photoconductor with a charge generating layer containing a phthalocyanine compound. The effect has been confirmed by referring to examples, although no explanation is made for a mechanism for providing the effect. The effect is thought to be derived from a material selected.

Still further, JP-A No. 2000-147803 has made such a proposal that a copolymerized polycarbonate of bisphenol A with a specific arylene group is used in a photoconductor surface layer such as a charge transporting layer to prevent the reverse polarity charge from being injected from the surface layer.

Further, JP-A No. 2001-235889 has made such a proposal that surface-treated metal oxide particles, an alcohol-soluble resin and an alcohol-soluble charge transporting material are contained as a surface-layer constituting material. It has been pointed out in this proposal that a thermoplastic resin is insufficient in strength and not suitable as a binder resin for the surface layer and a solvent for dissolving it on coating must be such a solvent that can easily dissolve the resin, thereby eliminating a method for dissolving a photosensitive layer (paragraph number [0009]). Although an explanation about a mechanism for the effect is not made, it is estimated by referring to the description of examples that an alcohol-soluble charge transporting material is used as a combination of these materials, thus making it possible to prevent the occurrence of afterimages.

Further, JP-A No. 2002-6528 has made such a proposal that in an electrophotographic photoconductor having a photosensitive layer and a protective layer, at least one of an alkaline metal element and an earth metal element is contained in the protective layer. This proposal is considered to be a unit in which these elements are contained in the protective layer, thereby giving ion conductivity to concurrently solve problems such as a decrease in durability and accumulation of remaining electric potential. This proposal has pointed out that an electron transporting material is contained in a protective layer, thereby making it possible to decrease the remaining electric potential, but also the durability results in a disadvantage of an increased friction amount (paragraph number [0019]).

(2) Improvement of Photosensitive Layer

For example, JP-A No. 2000-75521 has made such a proposal that at least one type of compound selected from chlorogallium phthalocyanine compounds and hydroxyl gallium phthalocyanine compounds is contained in an electron transporting is material, which is contained in an electrophotographic photoconductor, and also at least one type of specific compound having a hydrazone skeleton is contained as an electron transporting material. This proposal has described that a more favorable combination is found between a charge generating material and an electron transporting material between which charge is delivered, and if these substances are favorably combined, there is attained improvement in transfer memory and photo memory (paragraph numbers [0017] to [0021]). It is now difficult to estimate certain rules on whether they are favorably combined or not.

Further, JP-A No. 2000-105478 has made such a proposal that in an image forming apparatus based on the electrophotographic process which radiates short-wavelength semiconductor laser diode light of 380 nm to 500 nm into a photoconductor, an azo pigment is contained in a photosensitive layer. Although no explanation has been made for a mechanism for providing the effect, it has been confirmed by referring to the example that most of the azo pigments are lower in photo memory than a type titanyl phthalocyanine.

Further, JP-A No. 2001-305762 has made such a proposal that in an electrophotographic photoconductor containing a charge generating material and an electron transporting material, the electron transporting material contains a substance greater than 70 Å in polarizability, which is calculated by structural optimization based on semi-empirical molecular activation calculation in which PM3 parameters are used and also smaller than 1.8 D in calculation value of dipole moment, and also contains a compound having a wavelength at which the transmittance of 50% is found on the wavelength side longer than the wavelength at which the electron transporting material exhibits the transmittance of 50%. This proposal has discussed that the latter compound absorbs redundant light radiated into a photoconductor and, for this reason, there is improved the photo memory property (paragraph number [0071]).

(3) Improvement of Charge Transporting Layer

For example, JP-A No. 7-92701 has made such a proposal that in a stacked layer photoconductor, oxytitanium phthalocyanine is contained in a charge generating layer, two or more types of charge transporting materials are contained in a charge transporting layer, and individual charge transporting materials are set to be within 0.04V in oxidation potential difference. Although an ambiguous explanation has been made about a mechanism for providing the effect, the charge transporting materials are thought to be made equal in energy level, by which a smooth hopping can be given to charge carriers between the charge transporting materials, and the charge transporting materials are decreased in trapping, by which an absolute quantity of electrons excited due to antipolar charging by a transfer unit is decreased to prevent the occurrence of afterimages (paragraph numbers [0021] to [0022]).

Further, JP-A No. 8-152721 has made such a proposal that in an electrophotographic photoconductor loaded on a back-face exposure high-speed electrophotographic process (time from an exposure unit to a developing unit is about 10 msec to 150 msec), the charge mobility of a charge transporting layer is set to give $1\times10^{-6}$ $cm^2/V\cdot sec$ or more at the electric field strength of $2\times10^6$ V/cm. It has been pointed out that a slow dynamic sensitivity of a photoconductor will result in a failure in complete formation of a latent image before the development and repeated use of the photoconductor will increase an afterimage. There is proposed a unit in which the above disadvantages are eliminated, thereby securing characteristics of the dynamic sensitivity to prevent the occurrence of an afterimage (paragraph numbers [0010], [0043] to [0044]).

Further, JP-A No. 10-177262 has made such a proposal that in an image forming apparatus based on the electrophotographic process and equipped with an intermediate transfer member, an electron transporting material selected from triphenylamine compounds and N,N,N', N'-tetraphenyl benzidine compounds is contained in the charge transporting layer of a stacked-layer-structure electrophotographic photoconductor having a charge generating layer containing a phthalocyanine compound. Although no explanation has been made about a mechanism for providing the effect, the effect has been confirmed by referring to examples, and the effect is likely to be derived from a selected material.

(4) Improvement of Charge Generating Layer

For example, JP-A No. 6-313972 has proposed such a unit that a charge generating layer is made thick as much as 0.25 μm or more, or the content of a charge generating material in the charge generating layer is increased to as much as 50% by mass or more, by which the layer is trapped for a charge to a greater extent, and a ghost is consequently made less conspicuous.

Further, JP-A No. 10-69104 has made such a proposal that in a stacked-layer-structure electrophotographic photoconductor, a triaryl amine compound having a xylyl group is contained in a charge generating layer. This proposal has described that there is formed a carrier transport barrier on a boundary surface between the charge generating layer and the charge transporting layer at which a charge is trapped. Since the thus trapped carriers act to decrease a space electrical field in the charge generating layer, a half-tone image portion is not decreased in electric potential to result in the formation of an afterimage at this portion. Therefore, a charge transport agent (xylyl group-containing triaryl amine compound) is mixed in the charge generating layer, thereby generated carriers are smoothly injected into the charge transport agent and moved to the charge transporting layer. As a result, the thus trapped carriers are prevented from accumulation to decrease the occurrence of afterimages (paragraph numbers [0011] to [0012]).

Still further, JP-A No. 10-186696 has made such a proposal that in an electrophotographic photoconductor having at least a photosensitive layer and a surface protective layer in this order on the electric-conductive substrate, oxytitanium phthalocyanine, which has a strong peak at the diffraction angle ($2\theta\pm0.2°$) of 9.5°, 24.1° and 27.3° on X-ray diffraction of CuKα characteristics, as a charge generating material, is contained in the photosensitive layer. Although no explanation has been made about a mechanism for providing the effect, the effect has been confirmed by referring to examples and the effect is likely to be derived from a selected material.

Further, JP-A No. 2002-107972 has made such a proposal that a butyral resin constituted with hydroxy gallium phthalocyanine, an acetalization portion (binder resin), an acetyl group portion and a hydroxyl group portion, which is 62 mole percent or more in butyralization degree, $2.0\times10^5$ or more in mass average molecular weight and $5.0\times10^4$ or more in number average molecular weight, is contained as a material constituting a charge generating layer. It is estimated that a decreased quantity of photo carriers remaining on the photosensitive layer results in improvement of afterimages due to the effect of the butyral resin having the above-described specific constitution (for example, influence of the number of hydroxyl groups).

(5) Regulation of Matching Charge Generating Layer with Charge Transporting Layer For example, JP-A No. 7-43920 has made such a proposal that in a stacked-layer-structure electrophotographic photoconductor, a specific azo pigment is contained in a charge generating layer, and an electron transporting material having a fluorene skeleton is also contained in a charge transporting layer. Although no explanation has been made about a mechanism for providing the effect, the effect of inhibiting light-induced fatigue has been confirmed by referring to examples and the effect is likely to be derived from a selected material.

Further, JP-A No. 9-211876 has made such a proposal that in a photoconductor which exhibits negative-polar high gamma characteristics, there is provided a stacked layer constitution in which a charge generating layer, which contains a phthalocyanine compound, and a P-type charge transporting layer are formed on an electric-conductive substrate, and a material selected from inorganic P-type semiconductors, t-Se fine particles and charge transport polymers is used in the P-type charge transporting layer. This proposal has described that there is a feature that the P-type charge transporting layer is free of positive-hole transporting molecules, thereby positive-hole transporting molecules are prevented from being dispersed into the charge generating layer, and trap by the phthalocyanine pigment is prevented to decrease the occurrence of afterimages (paragraph numbers [0003] and [0012]).

(6) Improvement of Under Layer

For example, JP-A No. 8-22136 has made such a proposal that an under layer prepared by using a silane coupling agent and an inorganic pigment is installed on an electrophotographic photoconductor. As a result, a charge which should flow to a substrate (substrate) will flow smoothly to cause no afterimage (paragraph number [0017]).

Further, JP-A No. 11-184127 has made such a proposal that in a photoconductor having an under layer (intermediate layer), polyimide structure resins with a specific polyamic acid structure or a polyamic acid ester structure and a specific-structure and a cyanoethyl-group resin are contained in the under layer. Although no explanation has been made in this proposal about a mechanism for providing the effect, the effect of inhibiting light-induced fatigue has been confirmed by referring to examples, and the effect is likely to be derived from a selected material.

Further, JP-A No. 2000-112162 has described that a cross-linking resin, the resistance value of which is less vulnerable to change in external humidity, is used in an under layer (intermediate layer) (paragraph number [0004]). The above-described JP-A No. 2000-112162 has described various proposals in reducing the occurrence of afterimages, that is, an example in which polycyclic quinone, perylene and others are contained in the under layer (JP-A No. 8-146639), an example in which a metallocen compound, an electron withdrawing compound and a melamine resin are used (JP-A No. 10-73942), an example in which fine particles of a metal oxide and a silane coupling agent are used (JP-A No. 2002-107972), and an example in which fine particles of a metal oxide surface-treated by a silane coupling agent are used (JP-A No. 9-258469).

Still further, in the case of a highly-sensitive electrophotographic photoconductor in which oxytitanium phthalocyanine is used in a charge generating layer, it has been pointed out that the high sensitivity of the photoconductor has led to a greater absolute number of excited molecules and generated carriers, thereby excited seeds, electrons and holes, which do not undergo charge separation in an electrophotographic process of repeating charge and exposure, are more likely to remain on the photoconductor (paragraph number [0010]).

Further, JP-A No. 2000-112162 has made such a proposal that a polyamide resin, a zirconium compound or a polyamide resin, and a diketone compound such as zirconium alkoxide and acetyl acetone are contained as an under layer constituting material. Similarly, JP-A No. 2001-51438 has made such a proposal that a cellulose resin is used as a resin for the under layer, and also a zirconium compound or zirconium alkoxide and a diketone compound are contained.

Further, JP-A No. 2001-305763 has made such a proposal that in an electrophotographic photoconductor, which contains an under layer, a charge generating material and an electron transporting material, the electron transporting material is a substance greater than 70 Å in value of polarizability calculated by structural optimization based on semi-empirical molecular activation calculation in which PM3 parameters are used and also smaller than 1.8 D in calculation value of dipole moment or a specific arylamine compound, and a polyamide having titanium oxide particles coated with an organic silicon compound and a specific-structured diamine composition as its constituents is contained in the under layer. JP-A No. 2001-305763 has confirmed that the under layer is installed to improve characteristics of photo memory. The under layer is installed as this mechanism, by which carriers remaining on a photosensitive layer may be allowed to move out easily (paragraph number [0075]).

Further, JP-A No. 2002-107983 has made such a proposal that in a stacked layer photoconductor having an under layer (intermediate layer), the volume resistivity of the under layer is set to be from $10^{10}$ to $10^{12}$ Ωcm, the thickness of a charge transporting layer is set to be 18 μm or less, and a charge eliminating unit is omitted. In this proposal, the antistatic unit (charge eliminating light) is omitted, thereby preventing light-induced fatigue of the photoconductor, and the under layer is regulated for resistance, thereby controlling the charge injection from a substrate to the photoconductor, thus making it possible to prevent the accumulation of a space charge (paragraph numbers [0005], [0025] to [0029].

(7) Formulation of Additives

For example, JP-A No. 10-177261 has made such a proposal that in an image forming apparatus based on electrophotographic process, which has an intermediate transfer member, at least a hindered phenol structure unit is contained in the surface layer of a stacked-layer-structure electrophotographic photoconductor having a charge generating layer containing a phthalocyanine compound. Although no explanation has been made about a mechanism for providing the effect, the effect has been confirmed by referring to examples. The effect is thought to be derived from a selected material.

Further, JP-A No. 2000-292946 has made such a proposal that a dithiobenzyl compound is contained in a charge generating layer in which a phthalocyanine pigment is used. Although an explanation about a mechanism for providing the effect has been omitted, examples have shown the improvement in accumulated photo memory and positive ghost.

(8) Modification of Electrophotographic Process

For example, JP-A No. 7-13374 has made such a proposal that a photoconductor is used by being charged or allowed to stand, with the polarity being reversed (plus) to a normal charge, under predetermined conditions. In the case of a photoconductor having a high-sensitive charge transporting layer, largely found are light-induced charge carriers generated on exposure. The light-induced charge carriers generate the same number of electrons as that of the holes injected into a charge transporting layer. However, if the electrons fail in quickly moving to a substrate, they remain on the charge generating layer to result in the formation of afterimages. Therefore, a positive charge is intentionally conducted to inject the electrons from the substrate, thus retaining an electron trap inside the charge generating layer. The proposal is considered as a unit in which on exposure of the photoconductor, with this state kept, there is found a smaller difference in electron trap between an exposure portion and a non-exposure portion, thus making a ghost image less conspicuous (paragraph numbers [0016] to [0022]).

Further, JP-A No. 7-44065 has proposed a unit in which alternating-current overlapped direct current electricity is applied to the substrate of a photoconductor. This unit is interpreted as a unit for applying electrons trapped on a charge generating layer to the substrate in a reverse bias manner so that they are allowed to move out. It has been described that alternating current is overlapped for the purpose of increasing a quantity of current flow to accelerate the reversely-charged bias effect (paragraph numbers [0019] to [0021]).

Still further, JP-A No. 10-123802 has made such a proposal that a stacked-layer structure electrophotographic photoconductor with a charge generating layer containing a phthalocyanine compound is subjected to charge (other than primary charge), then, to static elimination by light, primary charge is conducted from the time when a portion of the electrophotographic photoconductor, which is initially subjected to the primary charge, advances into a position opposing a unit of conducting the primary charge, thereby making it possible to form an image in a state that a space charge inside the photoconductor is liberated and eliminated and also to prevent the occurrence of afterimages at an initial stage of image formation (paragraph numbers [0012], [0020]).

Further, JP-A No. 10-123855 has made such a proposal that a control unit for controlling at a constant level a transfer current flowing into the photoconductor from a transfer unit is installed on a stacked-layer-structure electrophotographic photoconductor with a charge generating layer containing a phthalocyanine compound. According to this proposal, an afterimage occurs, depending on the transfer current, and a negative afterimage appears more clearly as the transfer current is made larger. This is estimated to be due to a mechanism that holes (positive holes) are injected into a non-exposure portion (no image portion) of the photoconductor on transfer, the holes are trapped on the boundary surface of a charge generating layer or of a charge transporting layer on a base material side, liberated at the time of a next charge process, and increased in dark decay (apparent intensification), thereby generating a negative afterimage. Therefore, values of the transfer current are controlled at a constant level, by which charge injected into the photoconductor can be constantly controlled to result in the prevention of an afterimage (paragraph number [0012]).

Further, JP-A No. 2000-231246 has proposed a unit of regulating writing light wavelength or antistatic light wavelength by referring to action spectra of a light memory ratio before a charge with respect to the sensitivity.

Still further, JP-A No. 10-123856 has made such a proposal that a stacked-layer-structure electrophotographic photoconductor with a charge generating layer containing a phthalocyanine compound is subjected to exposure before transfer, by which the charged electric potential at a non-exposure portion can be reduced to one-third of that before exposure, thereby preventing the occurrence of an afterimage. No detailed explanation has been made about a mechanism for providing the effect. However, exposure before transfer would decrease a gap difference in electric potential between an exposure portion and a non-exposure portion, thus making an afterimage undistinguishable.

Further, JP-A No. 10-246997 has made such a proposal that in an image forming apparatus based on electrophotographic process which uses an electrophotographic photoconductor with a protective layer containing a photosensitive layer and a photocurable resin (acryl resin), a humidity sensor is installed near the surface of the electrophotographic photoconductor. In this proposal, the humidity sensor is to control current values of an alternating current component applied to a charge member. This proposal has described a mechanism for reducing a rough image and a blurred image on installation of the humidity sensor but has not described an effect of the mechanism on reduction in photo memory. Examples have confirmed the reduction in photo memory on installation of the humidity sensor.

Further, JP-A No. 2001-117244 has made such a proposal that the half time of a charged electric potential of a photoconductor on exposure calculated by the zerographic TOF method is reduced to 1/10 or less the time from an exposure unit to a developing unit in the image forming apparatus based on electrophotographic process (hereinafter, sometimes referred to as "exposure-development time") as measures for preventing the occurrence of ghost images in an S-letter shaped photoconductor.

Further, as described in the above Section of "Improvement of under layer," in JP-A No. 2002-107983, there is proposed a method in which a charge eliminating unit (charge eliminating light) is omitted, thereby preventing the light-induced fatigue of a photoconductor.

Further, JP-A No. 2002-123067 has made such a proposal that if time from charge to exposure is given T; charged electric potential on the surface of a photoconductor, VH; electric potential which is dark-decayed until 10 T after being charged, V1; and electric potential which is dark-decayed until 10 T after being re-charged following the passage of charge and image exposure, V2; the relationship of $|(V1-V2)/VH|<0.020$ is satisfied. This proposal has described such an example that the process speed is increased to shorten the dark-decay time or the charged electric potential is decreased as an actual unit.

In order to prevent the occurrence of afterimages, we attempted to put into practical use conventional technologies described in the documents so far explained, finding that these technologies are only insufficiently applicable to an electrophotographic photoconductor intended for prints high in durability, speed and quality as well as to an image forming apparatus based on an electrophotographic process in which the above-described electrophotographic photoconductor is used. Therefore, these technologies are unable to solve problems.

BRIEF SUMMARY OF THE INVENTION

It is an object of the present invention to provide high-quality, stable image forming apparatus and method, which are free from abnormal images, particularly afterimages, after prolonged repeated use.

In order to solve the above problems, the present inventor and others have diligently studied an apparatus for forming an image high in durability and quality, which will not affect the basic electrophotographic characteristics or develop an abnormal image upon abrasion of a photoconductor resulting from prolonged and repeated use, finding that the apparatus is provided with at least a photoconductor, a latent electrostatic image forming unit configured to form a latent electrostatic image on the photoconductor, a developing unit for developing the latent electrostatic image by using toner to form a visible image and a transfer unit configured to transfer the visible image onto a recording medium, in which the photoconductor contains as a charge generating material on a substrate crystalline titanyl phthalocyanine having a maximum diffraction peak of at least 27.2° as a diffraction peak (±0.2°) of the Bragg angle 2θ with respect to the Cu-Kα line (wavelength of 1.542 Å), having major peaks at 9.4°, 9.6°, 24.0° and also having a peak at 7.3° as a diffraction peak on the lowest angle side but not having a peak between the peak of 7.3° and that of 9.4°, and X-metal free phthalocyanine, and the photoconductor is also formed with a single-layered photosensitive layer at least containing an electron transporting material, a positive-hole transporting substance and a binder resin represented by the following General Formula (1), thus making it possible to solve the above problems and to output a favorable image without abnormal images such as an afterimage after prolonged repeated use of the photoconductor.

General Formula (1)

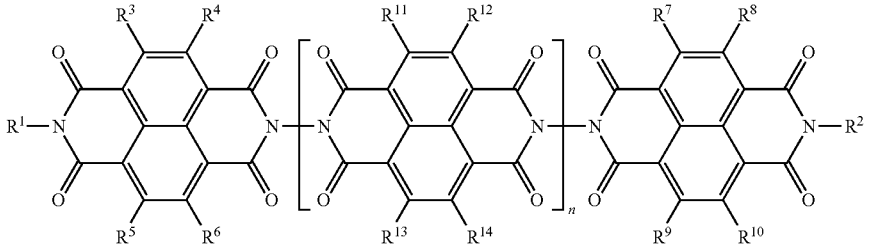

In the General Formula (1), $R^1$ and $R^2$ may be the same or different from each other and each represent any one of a hydrogen atom, an alkyl group that may have a substituent group, a cycloalkyl group that may have a substituent group and an aralkyl group that may have a substituent group; $R^3$, $R^4$, $R^5$, $R^6$, $R^7$, $R^8$, $R^9$, $R^{10}$, $R^{11}$, $R^{12}$, $R^{13}$, and $R^{14}$ may be the same or different from each other and each represent any one of a hydrogen atom, a halogen atom, a cyano group, a nitro group, an amino group, a hydroxyl group, an alkyl group that may have a substituent group, a cycloalkyl group that may have a substituent group, and an aralkyl group that may have a substituent group; and "n" stands for the number of repeating units and is an integer of 0 to 100.

The present invention has been made on the basis of the findings by the present inventors. The means to solve the above-mentioned problems are as follows. Namely, <1> An image forming apparatus having at least a photoconductor, a latent electrostatic image forming unit configured to form a latent electrostatic image on the photoconductor, a developing unit configured to develop the latent electrostatic image using a toner to form a visible image, and a transfer unit configured to transfer the visible image onto a recording medium, wherein the photoconductor has at least a substrate and a single-layered photosensitive layer over the substrate, and the photosensitive layer contains at least a charge generating material, an electron transporting material, a positive-hole transporting substance and a binder resin; the charge generating material contains crystalline titanyl phthalocyanine having a maximum diffraction peak of at least 27.2° as a diffraction peak ±0.2° of the Bragg angle 2θ with respect to the Cu-Kα line of the wavelength of 1.542 Å, further having major peaks at 9.4°, 9.6°, 24.0°, and also having a peak at 7.3° as a diffraction peak on the lowest angle side but not having a peak between the peak of 7.3° and that of 9.4°, and X-metal free phthalocyanine; and the electron transporting material contains a compound represented by the following General Formula (1), where, $R^1$ and $R^2$ may be the same or different from each other and each represent any one of a hydrogen atom, an alkyl group that may have a substituent group, a cycloalkyl group that may have a substituent group and an aralkyl group that may have a substituent group; $R^3$, $R^4$, $R^5$, $R^6$, $R^7$, $R^8$, $R^9$, $R^{10}$, $R^{11}$, $R^{12}$, $R^{13}$, and $R^{14}$ may be the same or different from each other and each represent any one of a hydrogen atom, a halogen atom, a cyano group, a nitro group, an amino group, a hydroxyl group, an alkyl group that may have a substituent group, a cycloalkyl group that may have a substituent group, and an aralkyl group that may have a substituent group; and "n" stands for the number of repeating units and is an integer of 0 to 100.

<2> The image forming apparatus according to the item <1>, wherein the photosensitive layer is prepared from a photosensitive layer coating solution, which is a mixture of two charge generating material dispersions prepared by respectively dispersing crystalline titanyl phthalocyanine, and X-metal free phthalocyanine with a solution prepared by dissolving a binder resin, an electron transporting material and a positive-hole transporting substance.

<3> The image forming apparatus according to any one of the items <1> to <2>, wherein the positive-hole transporting substance contains a compound represented by the following General Formula (i), General Formula (i)

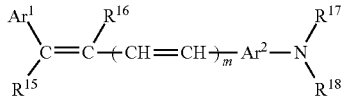

General Formula (1)

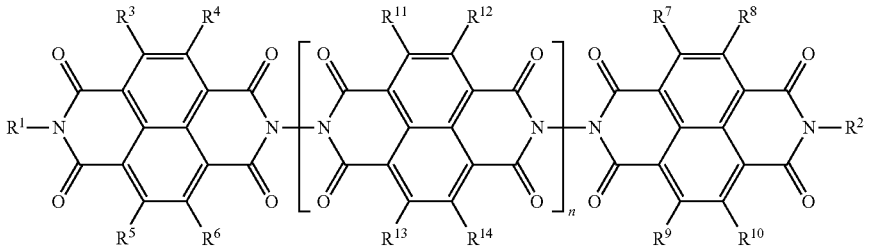

wherein $R^{15}$, $R^{16}$, $R^{17}$ and $R^{18}$ may be the same or different from each other and each represent any one of a hydrogen atom, an alkyl group that may have a substituent group and an aryl group that may have a substituent group; $Ar^1$ represents an aryl group that may have a substituent group. $Ar^2$ represents an arylene group that may have a substituent group; $Ar^2$ and $R^{15}$ may be combined to form a ring; and "m" is an integer of 0 or 1.

<4> The image forming apparatus according to any one of the items <1> to <3>, wherein a binder resin has a polycarbonate structure.

<5> The image forming apparatus according to any one of the items <1> to <4>, further having a rubbing member which makes contact with and rubs the surface of the photoconductor.

<6> The image forming apparatus according to any one of the items <1> to <5>, wherein the image forming apparatus is a tandem-type apparatus in which a plurality of image forming elements each equipped with at least a photoconductor, a latent electrostatic image forming unit configured to form a latent electrostatic image on the photoconductor, a developing unit configured to develop the latent electrostatic image using a toner to form a visible image and a transfer unit configured to transfer the visible image onto a recording medium, are arranged <7> The image forming apparatus according to any one of the items <1> to <6>, wherein the image forming apparatus has an intermediate transfer member to which the visible image formed on the photoconductor is primarily transferred and a transfer unit configured to secondarily transfer the visible image carried on the intermediate transfer member to a recording medium, a plurality of color toner images are sequentially superimposed on the intermediate transfer member to form a color image, and the color image is secondarily transferred onto the recording medium at a time.

<8> The image forming apparatus according to any one of the items

<1> to <6>, being a process cartridge which has a photoconductor and at least one unit selected from a charge unit, a developing unit, a transfer unit, a cleaning unit and a charge eliminating unit.

<9> An image forming method which includes at least forming a latent electrostatic image on a photoconductor, developing the latent electrostatic image using a toner to form a visible image, and transferring the visible image on a recording medium, wherein the photoconductor has at least a substrate and a single-layered photosensitive layer over the substrate, and the photosensitive layer contains at least a charge generating material, an electron transporting material, a positive-hole transporting substance and a binder resin; the charge generating material contains crystalline titanyl phthalocyanine having a maximum diffraction peak of at least 27.2° as a diffraction peak ±0.2° of the Bragg angle 2θ with respect to the Cu-Kα line of the wavelength of 1.542 Å, further having major peaks at 9.4°, 9.6°, 24.0°, and also having a peak at 7.3° as a diffraction peak on the lowest angle side but not having a peak between the peak of 7.3° and that of 9.4°, and X-metal free phthalocyanine; and the electron transporting material contains a compound represented by the following General Formula (1), General Formula (1)

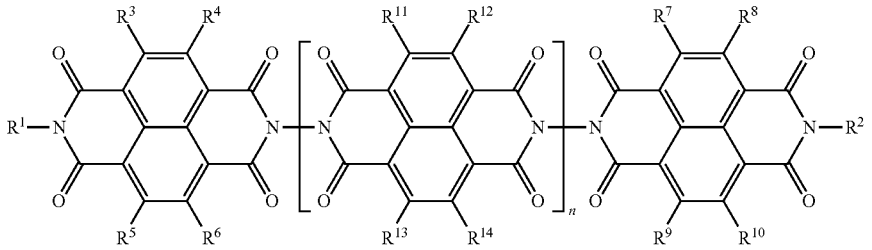

where, $R^1$ and $R^2$ may be the same or different from each other and each represent any one of a hydrogen atom, an alkyl group that may have a substituent group, a cycloalkyl group that may have a substituent group and an aralkyl group that may have a substituent group; $R^3$, $R^4$, $R^5$, $R^6$, $R^7$, $R^8$, $R^9$, $R^{10}$, $R^{11}$, $R^{12}$, $R^{13}$, and $R^{14}$ may be the same or different from each other and each represent any one of a hydrogen atom, a halogen atom, a cyano group, a nitro group, an amino group, a hydroxyl group, an alkyl group that may have a substituent group, a cycloalkyl group that may have a substituent group, and an aralkyl group that may have a substituent group; and "n" stands for the number of repeating units and is an integer of 0 to 100.

<10> The image forming method according to the item <9> wherein the photosensitive layer is prepared from a photosensitive layer coating solution, which is a mixture of two charge generating material dispersions prepared by respectively dispersing crystalline titanyl phthalocyanine, and X-metal free phthalocyanine with a solution prepared by dissolving a binder resin, an electron transporting material and a positive-hole transporting substance.

<11> The image forming method according to any one of the items <9> to <10>, wherein the positive-hole transporting substance contains a compound represented by the following General Formula (i), General Formula (i)

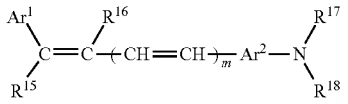

wherein $R^{15}$, $R^{16}$, $R^{17}$ and $R^{18}$ may be the same or different from each other and each represent any one of a hydrogen atom, an alkyl group that may have a substituent group and an aryl group that may have a substituent group; $Ar^1$ represents an aryl group that may have a substituent group. $Ar^2$ represents an arylene group that may have a substituent group; $Ar^1$ and $R^{15}$ may be combined to form a ring; and "m" is an integer of 0 or 1.

<12> The image forming method according to any one of the items <9> to <11>, wherein a binder resin has a polycarbonate structure.

The image forming apparatus of the present invention is that which is provided with a photoconductor, a latent electrostatic image forming unit, a developing unit and a transfer unit, the photoconductor has at least a substrate and a single-layered photosensitive layer over the substrate, the photosensitive layer also contains a charge generating material, an electron transporting material, a positive-hole transporting substance and a binder resin, the charge generating material contains crystalline titanyl phthalocyanine having a maximum diffraction peak of at least 27.2° as a diffraction peak (±0.2°) of the Bragg angle 2θ with respect to the Cu-Kαline (wavelength of 1.542 Å), further having major peaks at 9.4°, 9.6°, 24.0° and also having a peak at 7.3° as a diffraction peak on the lowest angle side but not having a peak between the peak of 7.3° and that of 9.4°, and X-metal free phthalocyanine, and the electron transporting material contains a compound represented by the General Formula (1).

The electron transporting material represented by the General Formula (1) is excellent in electron transporting capacity and also quite stable against oxidative gas such as ozone and Nox. The electrophotographic process is inevitably involved in the production of ozone on the charge thereof, with the amount varied depending on the situation. Thus, a fact that the substance is stable against the above oxidative gas is quite important in obtaining a high-quality image output for a prolonged period of time.

Further, the electron transporting material represented by the above General Formula (1) is more excellent in inducing electrons from the charge generating material than an ordinary electron transporting material, allowing free positive holes to occur inside the charge generating material. These positive holes are remarkably effective in being caught by a trap on the surface of the charge generating material to reduce an empty trap. As a result, the sensitivity characteristics can be improved to a great extent. Particularly, where the charge generating material is crystalline titanyl phthalocyanine having a maximum diffraction peak of at least 27.2° as a diffraction peak (±0.2°) of the Bragg angle 2θ with respect to the Cu-Kα line (wavelength of 1.542 Å), having major peaks at 9.4°, 9.6°, 24.0° and also having a peak at 7.3° as a diffraction peak on the lowest angle side but not having a peak between the peak of 7.3° and that of 9.4°, it exhibits quite excellent light-induced discharge characteristics. However, in this case, although the light-induced discharge characteristics are excellent, there is found a tendency that the charged electric potential is apparently reduced after a repeated use. Consequently, a potential difference between an exposure portion at which image exposure is effected and a non-exposure portion at which image exposure is not effected is found as a history on the next charge. Then, the surface of the photoconductor is not uniformly charged to cause the previously described afterimages on a finally output image.

Further, when the crystalline titanyl phthalocyanine is added in a decreased quantity, the charging property is improved. However, if the added quantity is decreased to an extent where the charging property is effectively improved, the crystalline titanyl phthalocyanine is deteriorated in excellent light-induced discharge characteristics to give mediocre sensitivity characteristics, thereby failing in fully exhibiting excellent characteristics as an electron transporting material represented by the General Formula (1).

In order to cope with the above-described fact, the present inventor and others have made various evaluations, finding that the crystalline titanyl phthalocyanine and the X-metal free phthalocyanine are used together to greatly improve the charging property, with the high sensitivity characteristics kept. Further, since the X-metal free phthalocyanine can function as a charge generating material on single use, the combined use with the crystalline titanyl phthalocyanine makes it possible to greatly improve the durability of charging property on repeated use without substantially having adverse effects on the sensitivity, when used together with an electron transporting material represented by the General Formula (1). Excellent characteristics can be obtained particularly in combination with a positive-hole transporting substance represented by the General Formula (i), thus making it possible to provide a high-quality and stable image forming apparatus, which is free of change in charging property and the occurrence of afterimages after prolonged repeated use, with excellent light-induced discharge characteristics kept, due to the resulting synergistic effects. This combination is effective in improving stable charge as compared with the sole use of the crystalline titanyl phthalocyanine and is also far more excellent in light-induced discharge characteristics than the sole use of the X-metal free phthalocyanine.

DETAILED DESCRIPTION OF THE INVENTION (Image Forming Apparatus and Image Forming Method)

The image forming apparatus of the present invention is provided with at least a photoconductor, a latent electrostatic image forming unit configured to form a latent electrostatic image on the photoconductor, a developing unit configured to develop the latent electrostatic image using a toner to form a visible image and a transfer unit configured to transfer the visible image onto a recording medium. It is also provided with other units appropriately selected, whenever necessary, such as a fixing unit, a cleaning unit, a charge eliminating unit, a recycle unit and a control unit.

The image forming method of the present invention includes a latent electrostatic image forming step for forming a latent electrostatic image on the photoconductor, a developing step for developing the latent electrostatic image using a toner to form a visible image and a transfer step for transferring the visible image to a recording medium, and also includes other steps appropriately selected, whenever necessary, such as a fixing step, a cleaning step, an charge eliminating step, a recycle step and a control step.

The image forming method of the present invention can be favorably executed by the image forming apparatus of the present invention, the latent electrostatic image forming step can be performed by the latent electrostatic image forming unit, the developing step can be performed by the developing unit, the transfer step can be performed by the transfer unit, and the other steps can be performed by the other units.

-Electrostatic Latent Image Forming Step and Latent Electrostatic Image Forming Unit- The latent electrostatic image forming step is a step in which a latent electrostatic image is formed on a photoconductor.

<Photoconductor>

The photoconductor has at least a substrate and a single-layered photosensitive layer over the substrate, and also has other layers, whenever necessary.

A photosensitive layer constituted with a single layer (hereinafter, sometimes referred to as "single photosensitive layer") is used as the photosensitive layer. The single photosensitive layer is provided with a charge generating material contained in the entire photosensitive layer. Therefore, a charge can be generated near the surface layer and diffused to a less extent due to the repulsion of charge on charge transport, making it possible to form a fine latent image exactly according to an exposed image.

Figure 1:
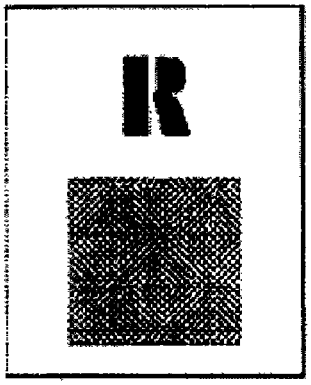
FIG. 1 is view for illustrating one example of an image pattern.
Figure 2:
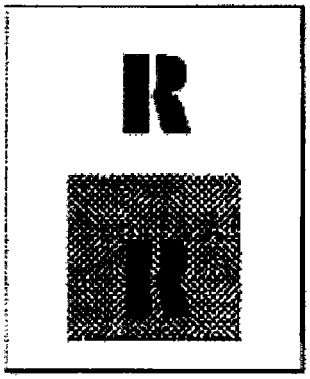
FIG. 2 is a view for illustrating one example of a positive afterimage.
Figure 3:
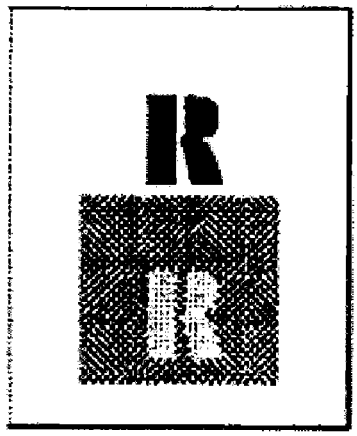
FIG. 3 is a view for illustrating one example of a negative afterimage.
Figure 4A:
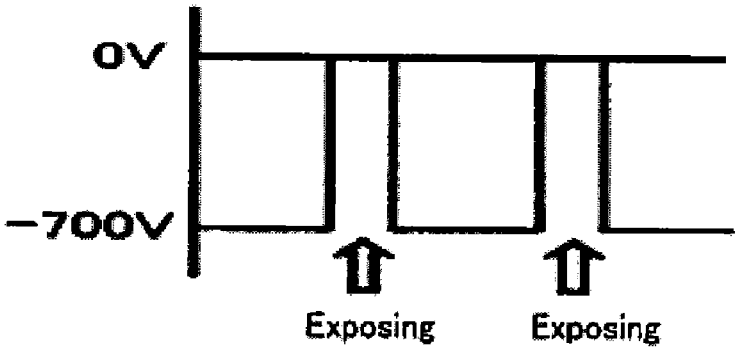
FIG. 4A is a view for explaining an electrical potential state of the surface electric potential of a photoconductor when a latent electrostatic image is formed by an image forming method.
Figure 4B:
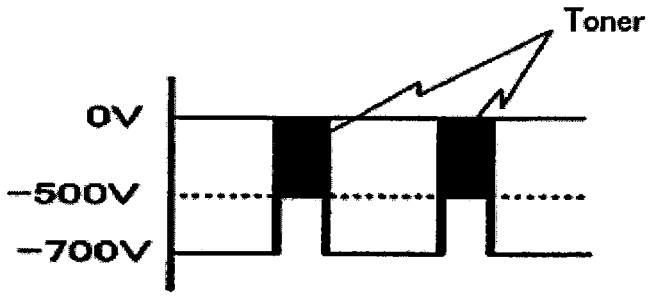
FIG. 4B is a view for explaining an electrical potential state of the surface electric potential of a photoconductor on development of the image by the image forming method.
Figure 4C:
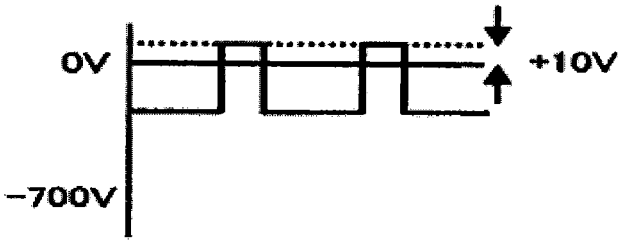
FIG. 4C is a view for explaining an electrical potential state of the surface electric potential of a photoconductor on transfer of the image by the image forming method.
Figure 5:
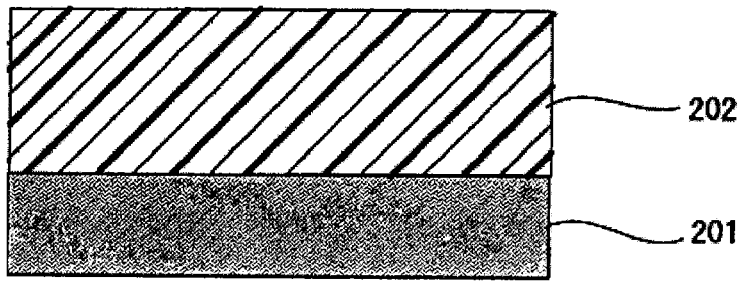
FIG. 5 is a schematic sectional view for illustrating one example of a photoconductor having a single-structured photosensitive layer used in the present invention.

In this instance, as shown in FIG. 5, the photoconductor has at least a single photosensitive layer 202 constituted with a single layer on a substrate 201 and also has other layers, whenever necessary.

<Photosensitive Layer>

The photosensitive layer contains at least a charge generating material, an electron transporting material, a positive-hole transporting substance and a binder resin. It also contains other compositions, whenever necessary.

-Charge Generating Substance-

The charge generating material contains crystalline titanyl phthalocyanine having a maximum diffraction peak of at least 27.2° as a diffraction peak (±0.2°) of the Bragg angle 2θ with respect to the Cu-Kα line (wavelength of 1.542 Å), having major peaks at 9.4°, 9.6°, 24.0°, and also having a peak at 7.3° as a diffraction peak on the lowest angle side but not having a peak between the peak of 7.3° and that of 9.4°, and X-metal free phthalocyanine.

The titanyl phthalocyanine can be represented by the structure shown in the following General Formula (A).

General Formula (A)

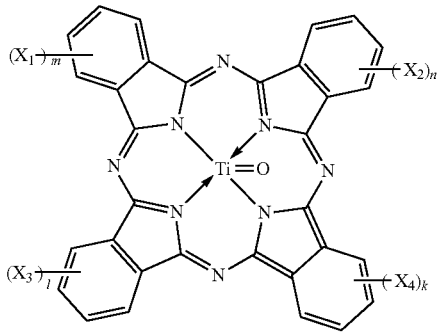

In the General Formula (A), $X_1$, $X_2$, $X_3$ and $X_4$ may be the same or different from each other, respectively represent any one of a hydrogen atom, each of various halogen atoms, an alkyl group and an alkoxy group; "n", "m", "l", and "k" may be the same or different from each other, and are respectively an integer of 0 to 4.

The above-described crystalline titanyl phthalocyanine is synthesized by the method described in JP-A No. 2001-19871, for example.

Further, the X-metal free phthalocyanine can be synthesized by a known method, or can be replaced by commercially available products. The commercially available products include, for example, FASTOGEN BLUE 8120B (Dainippon Ink and Chemicals Inc.).

The charge generating material is at first dispersed into an appropriate solvent by using a ball mill, attritor, sand mill or ultrasonic wave. In this instance, it is preferable in view of sensitivity characteristics that the crystalline titanyl phthalocyanine dispersion and the X-metal free phthalocyanine are dispersed so as to give 0.3 μm or less in volume average particle diameter of the respective phthalocyanine particles and 0.2 μm or less in standard deviation.

With this view taken into account, it is preferable that on dispersion, the crystalline titanyl phthalocyanine dispersion and the X-metal free phthalocyanine are individually dispersed and then mixed, and further mixed with a resin solution prepared by dissolving a binder resin to be described later. This is because the respective phthalocyanines are different in appropriate dispersion conditions, thereby making it difficult to obtain dispersion conditions for attaining a desired effect when they are mixed and dispersed at the same time.

There is no particular restriction on the solvent used at the time of the dispersion, and any known solvents can be used, including, for example, isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene and ligroin. Of these solvents, particularly preferable are ketone solvents, ester solvents and ether solvents.

A total content of the charge generating material in the photosensitive layer is preferably from 0.3% by mass to 10% by mass and more preferably from 0.5% by mass to 3% by mass.

The crystalline titanyl phthalocyanine and the X-metal free phthalocyanine may be added at any given proportion to the charge generating material. It is preferable in view of light-induced discharge characteristics that the proportion of the X-metal free phthalocyanine is up to 50%. Any proportion can be appropriately selected, depending on desired characteristics. In other words, where importance is placed on the light-induced discharge characteristics, the crystalline titanyl phthalocyanine is increased in proportion. Where importance is placed on the charging property rather than the light-induced discharge characteristics, the X-metal free phthalocyanine is increased in proportion. More specifically, where the proportion of the X-metal free phthalocyanine is ranged from 1% to 10%, the light-induced discharge characteristics are regarded as important, and where the proportion is ranged from 10% to 50%, the charging property is regarded as important. Where the proportion of the X-metal free phthalocyanine exceeds 50%, the light-induced discharge characteristics may be clearly decreased.

-Electron Transporting Substance-

A compound represented by the following General Formula (1) can be used as the electron transporting material.

General Formula (1)

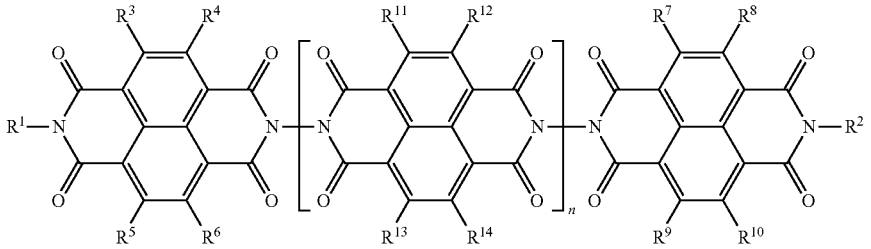

In the General Formula (1), $R^1$ and $R^2$ may be the same or different from each other and each represent any one of a hydrogen atom, an alkyl group that may have a substituent group, a cycloalkyl group that may have a substituent group and an aralkyl group that may have a substituent group; $R^3$, $R^4$, $R^5$, $R^6$, $R^7$, $R^8$, $R^9$, $R^{10}$, $R^{11}$, $R^{12}$, $R^{13}$, and $R^{14}$ may be the same or different from each other and each represent any one of a hydrogen atom, a halogen atom, a cyano group, a nitro group, an amino group, a hydroxyl group, an alkyl group that may have a substituent group, a cycloalkyl group that may have a substituent group, and an aralkyl group that may have a substituent group; and "n" stands for the number of repeating units and is an integer of 0 to 100.

As alkyl groups described in the General Formula (1), preferable are those of 1 to 25 carbon atoms, and more preferable are those of 1 to 10 carbon atoms. More specifically, examples thereof include, linear alkyl groups such as a methyl group, ethyl group, n-propyl group, n-butyl group, n-pentyl group, n-hexyl group, n-heptyl group, n-octyl group, n-nonyl group and n-decyl group; branched alkyl groups such as an i-propyl group, s-butyl group, t-butyl group, methyl propyl group, dimethyl propyl group, ethyl propyl group, diethyl propyl group, methyl butyl group, dimethyl butyl group, methyl pentyl group, dimethyl pentyl group, methyl hexyl group, and dimethyl hexyl group; other alkyl groups such as an alkoxyalkyl group, monoalkylaminoalkyl group, dialkylaminoalkyl group, halogen-substituted alkyl group, alkyl carbonylalkyl group, carboxyalkyl group, alkanoyloxy alkyl group, aminoalkyl group, alkyl group substituted with carboxyl group which may be esterified, and cyano group-substituted alkyl group. It is noted that there is no particular restriction on the position of these substituent groups, and a group in which carbon atoms of the substituted or unsubstituted alkyl group are partially substituted for hetero atoms (such as N, O, S) is also included in a substituted alkyl group. It is noted that there is no particular restriction on the position of these substituent groups, and a group in which carbon atoms of the substituted or unsubstituted alkyl group are partially substituted for hetero atoms (such as N, O, S) is also included in a substituted alkyl group.

The cycloalkyl groups described in the General Formula (1) are preferably those of 3 to 25 carbon atoms, more preferably those of 3 to 10 carbon atoms, including, for example, those with a similar ring from cyclopropane to cyclodecane; those having an alkyl substituent group such as methyl cyclopentane, dimethyl cyclopentane, methyl cyclohexane, dimethyl cyclohexane, trimethyl cyclohexane, tetramethyl cyclohexane, ethyl cyclohexane, diethyl cyclohexane, t-butylcyclohexane; and other cycloalkyl groups substituted with alkoxyalkyl group, monoalkyl aminoalkyl group, dialkylamino alkyl group, halogen-substituted alkyl group, alkoxycarbonylalkyl group, carboxyalkyl group, alkanoyloxy alkyl group, aminoalkyl group, halogen atom, amino group, carboxyl group which may be esterified, cyano group and others. It is noted that there is no particular restriction on the position of these substituent groups, and a group in which carbon atoms of the substituted or unsubstituted cycloalkyl group are partially substituted for hetero atoms (such as N, O, S) is also included in a substituted cycloalkyl group. The halogen atom includes, for example, a fluorine, chlorine, bromine or iodine atom The aralkyl groups described in the General Formula (1) include those in which an aromatic ring is substituted for the above substituted or unsubstituted alkyl group, and aralkyl groups of 6 to 14 carbon atoms are preferable. More specifically, they include, for example, a benzyl group, perfluorophenylethyl group, 1-phenylethyl group, 2-phenylethyl group, terphenylethyl group, dimethyl phenylethyl group, diethyl phenylethyl group, t-butylphenylethyl group, 3-phenylpropyl group, 4-phenylbutyl group, 5-phenylpentyl group, 6-phenylhexyl group, benzhydryl group, and trityl group.

It is noted that n stands for the number of repeating units, representing an integer of 0 to 100, and an integer of 0 to 5 is is preferable. Further, n can be calculated from the mass average molecular weight. In other words, a compound is found in a state of varying greatly in molecular weight. Where n exceeds 100, the compound is increased in molecular weight and decreases in solubility in various types of solvents. It is, therefore, desirable that n is 100 or less. On the contrary, where n is 1, substituent groups of $R^1$ and $R^2$, which are trimers of naphthalene carboxylates, are appropriately selected, thereby obtaining excellent electron transition characteristics, although they are oligomers. As described above, a wide range of naphthalene carboxylates from oligomers to polymers can be synthesized, depending on the number of repeating units, n.

In a range where the molecular weight of an oligomer is small, the synthesis is conducted in a step-wise manner to obtain a mono-dispersed compound. Where large in molecular weight, a compound varying greatly in molecular distribution is obtained.

Of these compounds, preferable is an electron transporting material represented by the following General Formula (I-1), n of which is 0.

General Formula (1-1)

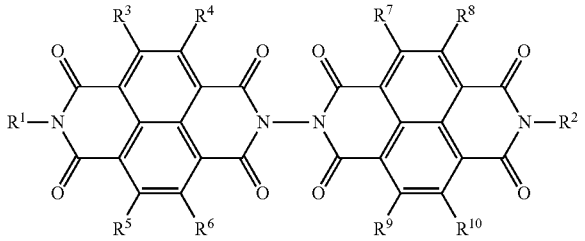

In the General Formula (I-1), $R^1$, $R^2$, $R^3$, $R^4$, $R^5$, $R^6$, $R^7$, $R^8$, $R^9$ and $R^{10}$ have the same meanings as those in the above described General Formula (1).

Still further, an electron transporting material represented by the following General Formula (I-2) is preferable.

General Formula (1-2)

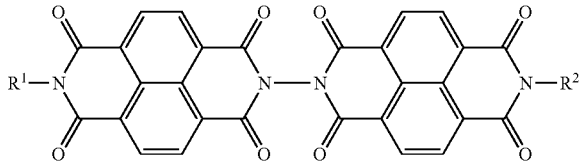

In the General Formula (I-2), $R^1$ and $R^2$ have the same meanings as those in the above-described General Formula (1).

Here, specifically, electron transporting materials represented by the following Structural Formulae (1) to (8) are preferable in view of obtaining a high quality image. It is noted that in these Structural Formulae, Me represents a methyl group.

Structural Formula (1)

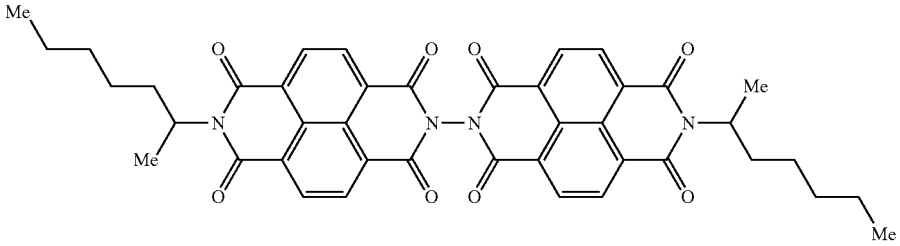

Structural Formula (2)

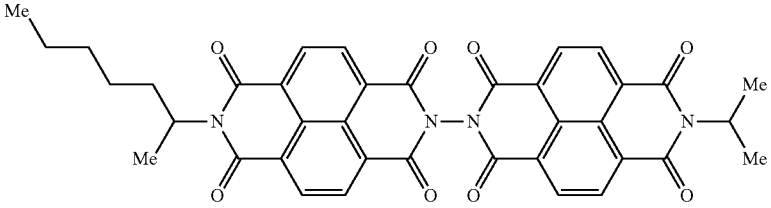

Structural Formula (3)

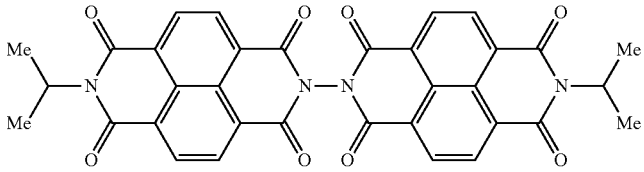

Structural Formula (4)

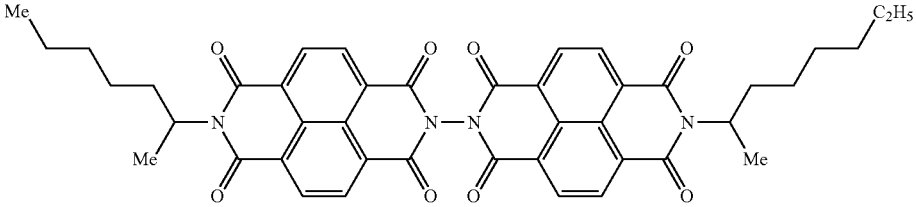

-continued

Structural Formula (5)

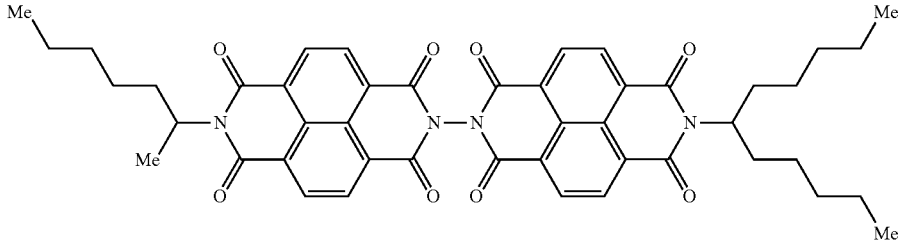

Structural Formula (6)

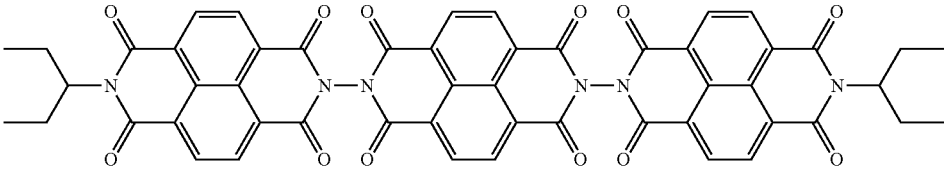

In the Structural Formula (6), the terminal group on both ends represents a Me (methyl) group.

Structural Formula (7)

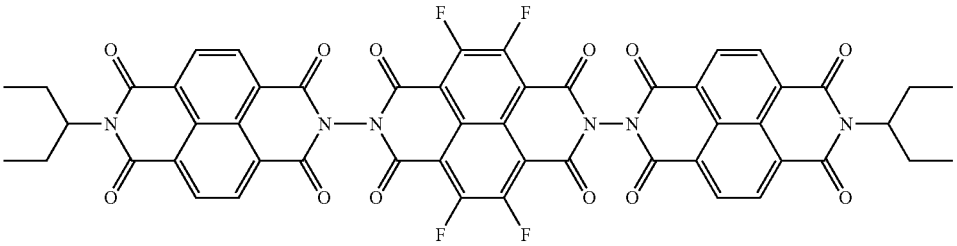

In the Structural Formula (7), the terminal group on both ends represents a Me (methyl) group.

Structural Formula (8)

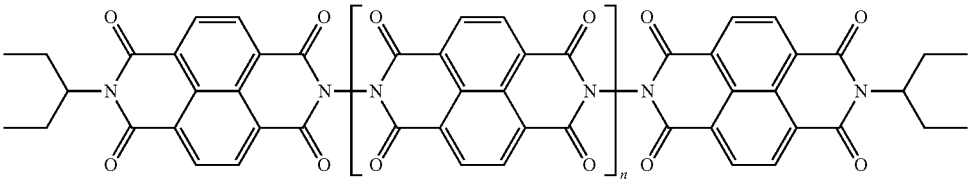

In the Structural Formula (8), the terminal group on both ends represents a Me (methyl) group, and "n" is an integer of 1 to 100.

Here, an electron transporting material represented by the General Formula (1) can be synthesized mainly by the following two methods.
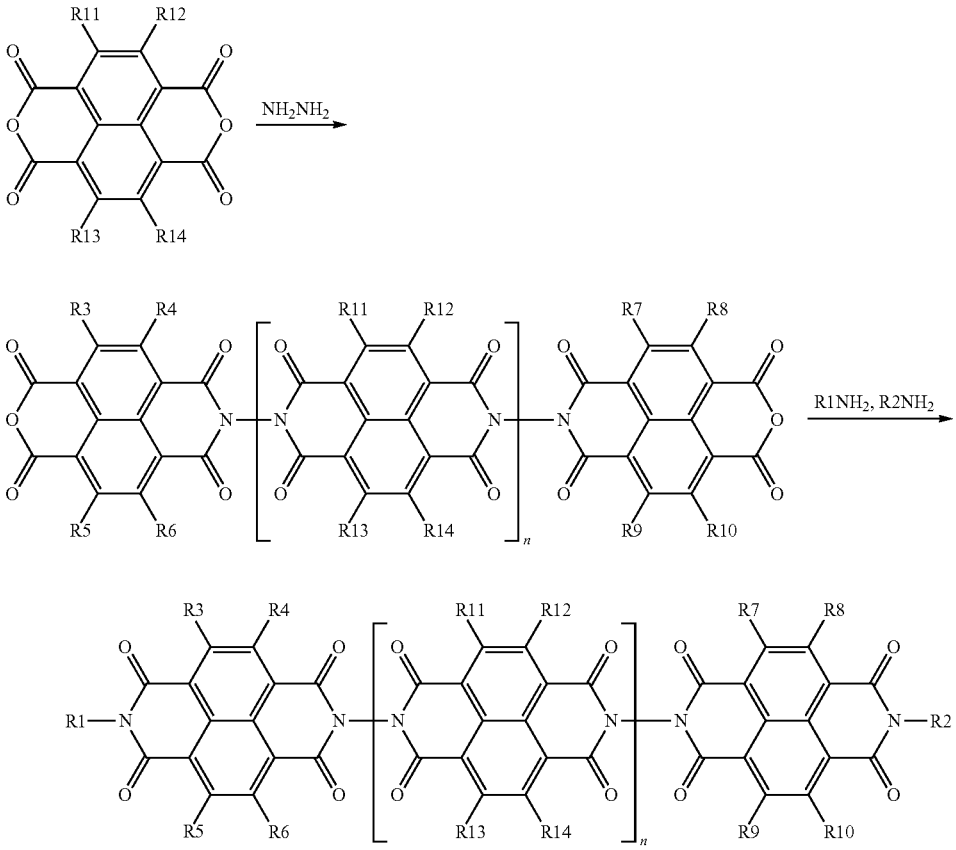
In the above reaction formulas, $R^1$ to $R^{14}$ and "n" have the same meanings as those in the General Formula (1).
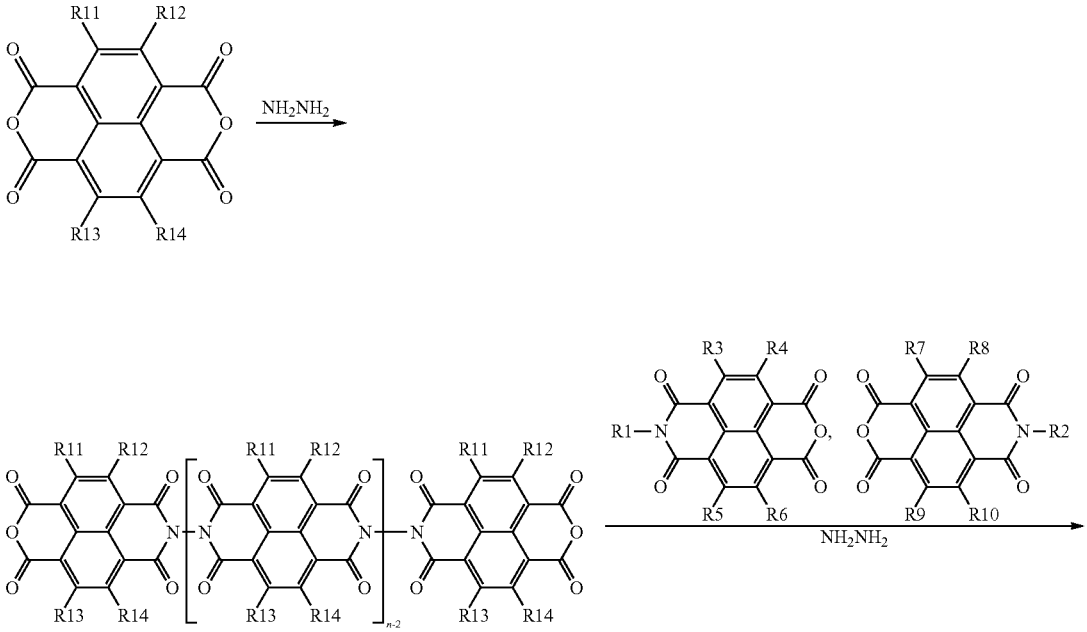

-continued

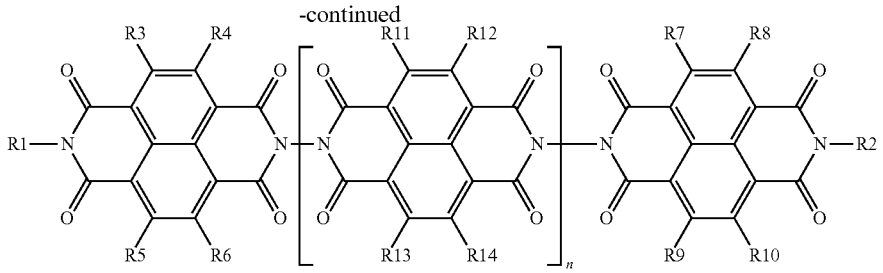

In the above reaction formulas, $R^1$ to $R^{14}$ and "n" have the same meanings as those in the General Formula (1).

The method for producing an electron transporting material represented by the General Formula (I-1) includes, for example, (i) a method in which naphthalene carboxylate or its anhydride is allowed to react with amines to produce a monoimide, and (ii) a method in which naphthalene carboxylate or its anhydride is adjusted for pH value by addition of a buffer solution, and the resultant is allowed to react with diamines.

The method (i) for producing a monoimide is conducted in the presence or absence of a solvent. There is no particular restriction on the solvent, and any solvent can be appropriately selected, depending on the purpose. Preferable are, for example, those which are not reactive with raw materials or products such as benzene, toluene, xylene, chloronaphthalene, acetic acid, pyridine, methylpyridine, dihmethyl formamide, dimethyl acetoamide, dimethylethylene urea, and dimethyl sulfoxide but reactive at temperatures from 50° C. to 250° C. Further, pH values are preferably adjusted by a buffer solution prepared by mixing a basic aqueous solution such as lithium hydroxide and potassium hydroxide with acid such as phosphoric acid.

The above-described carboxylic acid derivative dehydration reactions (i) and (ii) in which carboxylic acid is allowed to react with amines or diamines are conducted in the presence or absence of a solvent. There is no particular restriction on the solvent, and any solvent can be appropriately selected depending on the purpose. Preferable are, for example, those which are not reactive with raw materials or products such as benzene, toluene, chloronaphthalene, bromonaphthalene, and acetic anhydride but reactive at temperatures from 50° C. to 250° C. Any reaction may be conducted in the presence or absence of a catalyst. For example, molecular sieves, benzene sulfonic acid and p-toluene sulfonic acid can be used as a dehydrating agent on which there is no particular restriction.

In this instance, an electron transporting material represented by the Structural Formula (1) can be produced by the following method.

<First Step>

1,4,5,8-naphthalene tetracarboxylic acid dianhydride, 5.0 g, (18.6 mmol) and N,N-dimethyl formamide (DMF), 50 mL, were placed into a 200 mL four-neck flask, heated and refluxed. A mixture of 2-aminoheptane, 2.14 g, (18.6 mmol) with N,N-dimethyl formamide (DMF), 25 mL, was added dropwise while being stirred. After completion of addition, the resultant was heated and refluxed for 6 hours. After completion of the reaction, a container was cooled and the resultant was concentrated under reduced pressure. Toluene was added to a residue, which was purified by silica gel chromatography. Further, a collected product was recrystallized by adding toluene/hexane to obtain 2.14 g of monoimide A (yield of 31.5% by mass).

<Second Step>

The monoimide A, 2.0 g, (5.47 mmol), hydrazine monohydrate, 0.137 g, (2.73 mmol), p-toluene sulfonic acid, 10 mg, and toluene, 50 mL, were placed into a 100 mL four-neck flask, and the resultant was heated and refluxed for 5 hours. After completion of the reaction, a container was cooled, and the resultant was concentrated under reduced pressure. A residue was purified by silica gel chromatography. Further, a collected product was recrystallized by adding toluene/ethyl acetate to synthesize 0.668 g of electron transporting material (yield of 33.7% by mass) represented by the Structural Formula (1).

Further, an electron transporting material represented by the Structural Formula (2) can be produced by the following method.

<First Step>

1,4,5,8-naphthalene tetracarboxylic acid dianhydride, 10 g, (37.3 mmol), hydrazine monohydrate, 0.931 g, (18.6 mmol), p-toluene sulfonic acid, 20 mg, and toluene, 100 mL, were placed into a 200 mL four-neck flask, heated and refluxed for 5 hours. After completion of the reaction, the container was cooled and the resultant was concentrated under reduced pressure. A residue was purified by silica gel chromatography. Further, a collected product was recrystallized by adding toluene/ethyl acetate to obtain 2.84 g of dimer C, (yield of 28.7% by mass).

<Second Step>

The dimer C, 2.5 g, (4.67 mmol), and N,N-dimethyl formamide (DMF), 30 mL, were placed into a 100 mL four-neck flask, and the resultant was heated and refluxed. A mixture of 2-aminopropane, 0.278 g, (4.67 mmol) with N,N-dimethyl formamide (DMF), 10 mL was added dropwise while being stirred. After completion of addition, the resultant was heated and refluxed for 6 hours. After completion of the reaction, a reaction container was cooled, and the resultant was concentrated under reduced pressure. Toluene was added to a residue, which was purified by silica gel chromatography to obtain 0.556 g of monoimide C (yield of 38.5% by mass).

<Third Step>

The monoimide C, 0.50 g, (1.62 mmol), N,N-dimethyl formamide (DMF), 10 mL, were placed into a 50 mL four-neck flask, heated and refluxed. A mixture of 2-aminoheptane, 0.186 g, (1.62 mmol) with N,N-dimethyl formamide (DMF), 5 mL, was added dropwise while being stirred. After completion of addition, the resultant was heated and refluxed for 6 hours. After completion of the reaction, a reaction container was cooled and the resultant was concentrated under reduced pressure. Toluene was added to a residue, which was purified by silica gel chromatography. Further, a collected product was recrystallized by adding toluene/hexane to obtain 0.243 g of electron transporting material (yield of 22.4% by mass) represented by the Structural Formula (2).

Further, an electron transporting material represented by the Structural Formula (3) can be produced by the following method.

<First Step>

1,4,5,8-naphthalene tetracarboxylic acid dianhydride, 5.0 g, (18.6 mmol), and N,N-dimethyl formamide (DMF), 50 mL, were placed into a 200 mL four-neck flask, heated and refluxed. A mixture of 2-aminoheptane, 1.10 g, (18.6 mmol) with N,N-dimethyl formamide (DMF), 25 mL, was added dropwise while being stirred. After completion of addition, the resultant was heated and refluxed for 6 hours. After completion of the reaction, a reaction container was cooled and the resultant was concentrated under reduced pressure. Toluene was added to a residue, which was purified by silica gel chromatography. Further, a collected product was recrystallized by adding toluene/hexane to obtain 2.08 g of monoimide B (yield of 36.1% by mass).

<Second Step>

The monoimide B, 2.0 g, (6.47 mmol), hydrazine monohydrate, 0.162 g, (3.23 mmol), p-toluene sulfonic acid, 10 mg, and toluene, 50 mL, were placed into a 100 mL four-neck flask, and the resultant was heated and refluxed for 5 hours. After completion of the reaction, the container was cooled, and the resultant was concentrated under reduced pressure. A residue was purified by silica gel chromatography. Further, a collected product was recrystallized by adding toluene/ethyl acetate to synthesize 0.810 g of electron transporting material (yield of 37.4% by mass) represented by the Structural Formula (3).

Further, an electron transporting material represented by the Structural Formula (4) can be produced by the following method.

<First Step>

The dimer C, 5.0 g, (9.39 mmol) and N,N-dimethyl formamide (DMF), 50 mL, were placed into a 200 mL four-neck flask, and the resultant was heated and refluxed. A mixture of 2-aminoheptane, 1.08 g, (9.39 mmol) with N,N-dimethyl formamide (DMF), 25 mL, was added dropwise while being stirred. After completion of the drops, the resultant was heated and refluxed for 6 hours. After completion of the reaction, the reaction container was cooled, and the resultant was concentrated under reduced pressure. Toluene was added to a residue, which was purified by silica gel chromatography to obtain 1.66 g of monoimide D (yield of 28.1% by mass).

<Second Step>

The monoimide D, 1.5 g, (2.38 mmol), and N,N-dimethyl formamide (DMF), 50 mL, were placed into a 100 mL four-neck flask, and the resultant was heated and refluxed. A mixture of 2-aminooctane, 0.308 g, (2.38 mmol) with N,N-dimethyl formamide (DMF), 10 mL, was added dropwise while being stirred. After completion of addition, the resultant was heated and refluxed for 6 hours. After completion of the reaction, a reaction container was cooled and the resultant was concentrated under reduced pressure. Toluene was added to a residue, which was purified by silica gel chromatography. Further, a collected product was recrystallized by adding toluene/hexane to obtain 0.328 g of electron transporting material (yield of 18.6% by mass) represented by the Structural Formula (4).

Further, an electron transporting material represented by the Structural Formula (5) can be produced by the following method.

<First Step>

The dimer C, 5.0 g, (9.39 mmol) and N,N-dimethyl formamide (DMF), 50 mL, were placed into a 200 mL four-neck flask, and the resultant was heated and refluxed. A mixture of 2-aminoheptane, 1.08 g, (9.39 mmol) with N,N-dimethyl formamide (DMF), 25 mL, was added dropwise while being stirred. After completion of addition, the resultant was heated and refluxed for 6 hours. After completion of the reaction, a reaction container was cooled, and the resultant was concentrated under reduced pressure. Toluene was added to a residue, which was purified by silica gel chromatography to obtain 1.66 g of monoimide D (yield of 28.1% by mass).

<Second Step>

The monoimide D, 1.5 g, (2.38 mmol), and N,N-dimethyl formamide (DMF), 50 mL, were placed into a 100 mL four-neck flask, and the resultant was heated and refluxed. A mixture of 6-aminoundecane, 0.408 g, (2.38 mmol) with N,N-dimethyl formamide (DMF), 10 mL, was added dropwise while being stirred. After completion of addition, the resultant was heated and refluxed for 6 hours. After completion of the reaction, a reaction container was cooled and the resultant was concentrated under reduced pressure. Toluene was added to a residue, which was purified by silica gel chromatography. Further, a collected product was recrystallized by adding toluene/hexane to obtain 0.276 g of electron transporting material (yield of 14.8% by mass) represented by the Structural Formula (5).

An electron transporting material represented by the Structural Formula (6) can be produced by the following method.

<First Step>

1,4,5,8-naphthalene tetracarboxylic acid dianhydride, 5.0 g, (18.6 mmol), and N,N-dimethyl formamide (DMF), 50 mL, were placed into a 200 mL four-neck flask, heated and refluxed. A mixture of 2-aminopentane, 1.62 g, (18.6 mmol) with N,N-dimethyl formamide (DMF), 25 mL, was added dropwise while being stirred. After completion of addition, the resultant was heated and refluxed for 6 hours. After completion of the reaction, a reaction container was cooled and the resultant was concentrated under reduced pressure. Toluene was added to a residue, which was purified by silica gel chromatography. Further, a collected product was recrystallized by adding toluene/hexane to obtain 3.49 g of monoimide E (yield of 45.8% by mass).

<Second Step>

The monoimide E, 3.0 g, (7.33 mmol), 1,4,5,8-naphthalene tetracarboxylic acid dianhydride, 0.983 g, (3.68 mmol), hydrazine monohydrate, 0.368 g, (7.33 mmol), p-toluene sulfonic acid, 10 mg, and toluene, 50 mL, were placed into a 100 mL four-neck flask, and the resultant was heated and refluxed for 5 hours. After completion of the reaction, the container was cooled and the resultant was concentrated under reduced pressure. A residue was purified twice by silica gel chromatography. Further, a collected product was recrystallized by adding toluene/ethyl acetate to obtain 0.939 g of compound (yield of 13.7% by mass) represented by the Structural Formula (6).

Since the mass spectrometric analysis (FD-MS) observed the peak at M/z=934, the substance was identified as a target substance. In the element analysis, calculation values were 66.81% for carbon, 3.67% for hydrogen, and 8.99% for nitrogen, whereas observed values were 66.92% for carbon, 3.74% for hydrogen, and 9.05% for nitrogen.

It is noted that any known electron transporting materials represented by the General Formula (1) can be used together, whenever necessary, as the above-described electron transporting material. They include, for example, chloranil, bromanil, tetracyano ethylene, tetracyano quinodimethane, 2,4,7-trinitro-9-fluorenone, 2,4,5,7-tetranitro-9-fluorenone, 2,4,5,7-tetranitroxanthone, 2,4,8-trinitrothio xanthone, 2,6,8-trinitro-4H-indeno [1,2-b]thiophene-4 on, 1,3,7-trinitrodibenzothiophene-5, and 5-dioxide. These electron transporting materials may be used solely or in combination of two or more of them.

There is no particular restriction on the content of the electron transporting material represented by the General Formula (1), and any content can be appropriately selected, depending on the purpose. The content is preferably from 10% by mass to 70% by mass with respect to a total solid content of an entire photosensitive layer and more preferably from 30% by mass to 60% by mass. Where the content is less than 10% by mass, there is a case that a sufficient electrostatic contrast may not be obtained or the effect of preventing abnormal images may not be sufficiently exhibited. Where the content exceeds 70% by mass, there are posed such problems that the friction resistance or withstand electric potential may be decreased to increase in dark decay.

-Positive-Hole Transporting Substance-

There is no particular restriction on the positive-hole transporting substance, and any known substance can be used. Particularly, preferable are an oxazole derivative, oxadiazole derivative (JP-A No. 52-139065, and 52-139066), imidazole derivative (Japanese Patent Application Publication (JP-B) No. 34-10366), triphenylamine derivative (U.S. Pat. No. 3,180,730 Specification), benzidine derivative (JP-B No. 58-32372), α-phenyl stilbene derivative (JP-A No. 57-73075), hydrazone derivative (JP-A No. 55-154955, 55-156954, 55-52063, and 56-81850), triphenyl methane derivative (JP-B No. 51-10983), anthracene derivative (JP-A No. 51-94829), styryl derivative (JP-A No. 56-29245, 58-198043), carbazole derivative (JP-A No. 58-58552), and pyrene derivative (JP-A No. 2-190863). Of these substances, a positive-hole transporting substance represented by the following General Formula (i) is particularly preferable in that quite excellent light-induced discharge characteristics are exhibited when used in combination with an electron transporting material represented by the General Formula (1).

General Formula (i)

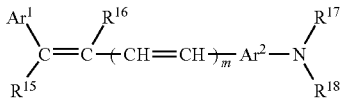

In the General Formula (1), $R^{15}$, $R^{16}$, $R^{17}$ and $R^{18}$ may be the same or different from each other, respectively represent any one of a hydrogen atom, an alkyl group that may have a substituent group and an aryl group that may have a substituent group. $Ar^1$ represents an aryl group that may have a substituent group. $Ar^2$ represents an arylene group that may have a substituent group. It is noted that $Ar^1$ and $R^{15}$ may be combined to form a ring. Further, "m" is an integer of 0 or 1.

Alkyl groups represented by the $R^{15}$, $R^{16}$, $R^{17}$ and $R^{18}$ include, for example, a methyl group, ethyl group, propyl group, isopropyl group, butyl group, isobutyl group, sec-butyl group, tert-butyl group, pentyl group, isopentyl group, neopentyl group, hexyl group, heptyl group, octyl group, nonyl group, decyl group, undecyl group, dodecyl group, vinyl group, benzyl group, phenethyl group, styryl group, cyclopentyl group, cyclohexyl group, cycloheptyl group, and cyclohexenyl group.

Aryl groups represented by the $R^{15}$, $R^{16}$, $R^{17}$ and $R^{18}$ include, for example, a phenyl group, a biphenyl group and a naphthyl group.

Further, the alkyl group and the aryl group may be further substituted with a substituent, including, for example, those further substituted with a group represented by the following Structural Formula, alkoxy group, carboxy group, or its ester, cyano group, alkyl amino group, aralkyl amino group, amino group, nitro group, acetylamino group and halogen atom, in addition to alkyl group, aromatic hydrocarbon group, and plural combinations of them.

The $Ar^1$ represents aryl groups which may have a substituent, including condensed polycylic hydrocarbon groups, non-condensed cyclic hydrocarbon groups and heterocyclic groups.

The condensed polycylic hydrocarbon groups include preferably those having 18 or less carbon atoms which forms a ring, including, for example, a pentanyl group, indenyl group, naphthyl group, azulenyl group, heptalenyl group, biphenylenyl group, as-indacenyl group, s-indacenyl group, fluorenyl group, acenaphthylenyl group, playadenyl group, acenaphthenyl group, phenalenyl group, phenanthryl group, anthryl group, fluorantenyl group, acephenanthylenyl group, aceanthlenyl group, triphenylyl group, pyrenyl group, crecenyl group, and naphthacenyl group.

The non-condensed cyclic hydrocarbon groups include, for example, monovalent groups of monocylic hydrocarbon compounds such as benzene, diphenyl ether, polyethylene diphenyl ether, diphenyl thioether and diphenyl sulfone; monovalent groups of non-condensed polycylic hydrocarbon compounds such as biphenyl, polyphenyl, diphenyl alkane, diphenyl alkene, diphenyl alkyne, triphenyl methane, distyryl benzene, 1,1-diphenyl cyclo alkane, polyphenyl alkane, and polyphenyl alkene; and monovalent groups of cyclic hydrocarbon compounds such as 9. 9-diphenyl fluorine.

The heterocyclic groups include, for example, monovalent groups such as carbazole, dibenzofuran, dibenzothiophene, oxadiazole, and thiadiazole.

The $Ar^2$ represents an arylene group that may have a substituent group, and a divalent group induced by an aryl group represented by the $Ar^1$.

The following show examples of compounds represented by the General Formula (1). However, it shall not be construed in any way that the present invention is limited to these structured compounds.

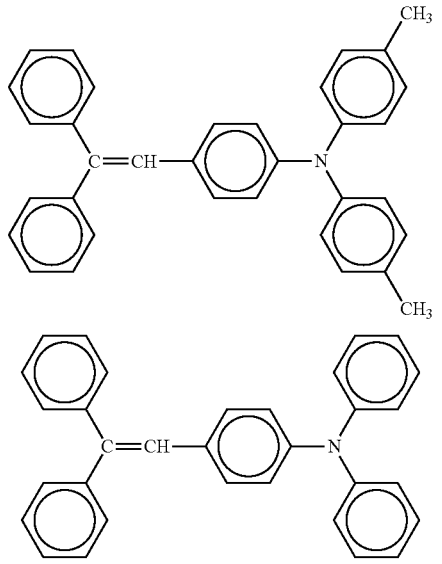

-continued

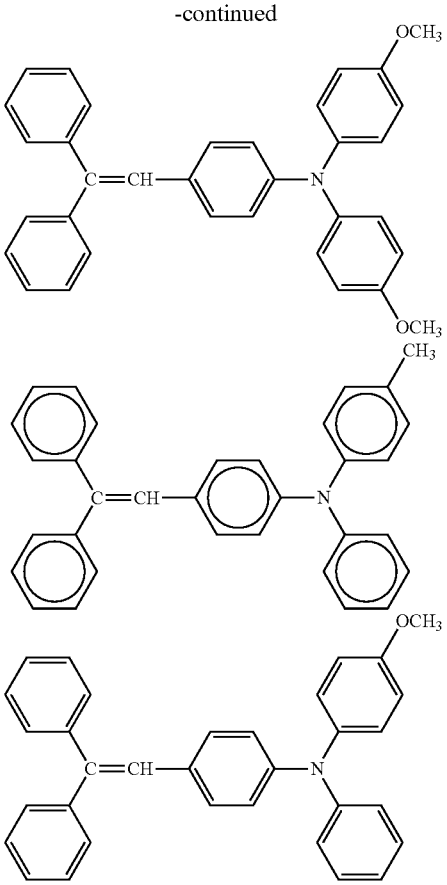

The content of the positive-hole transporting substance is preferably from 10% by mass to 70% by mass with respect to a total solid content of an entire photosensitive layer and more preferably from 20% by mass to 50% by mass.

-Binder Resin-

There is no particular restriction on the binder resin (sometimes, referred to as the binder resin), and any binder resin can be appropriately selected, depending on the purpose, including, for example, polyamide, polyurethane, epoxy resin, polyketone, polycarbonate, silicone resin, acryl resin, polyvinyl butyral, polyvinyl formal, polyvinyl ketone, polystyrene, poly-N-vinylcarbazole, polyallylate and poly acrylamide. These binder resins can be used solely or in combination of two or more of them. Particularly, preferable are such resins that have a polycarbonate structure excellent in friction resistance.

The photosensitive layer can be formed by a casting method in which a solution/dispersion system is used. In forming the photosensitive layer by the casting method, a solvent such as tetrahydrofuran, cyclohexanone, dioxane, dichloroethane, or butanone is at first used together with a binder resin, whenever necessary, to disperse the above-described charge generating material by using a ball mill, attritor, or sand mill, and others after an appropriate dilution of the thus prepared dispersion, a solvent such as tetrahydrofuran, cyclohexanone, dioxane, dichloroethane or butanone, is used together with an electron transporting material, a positive-hole transporting substance, the binder resin, and others to dissolve the resultant, and the dissolution is coated to form a film. The coating can be conducted, for example, by immersion coating, spray coating, bead coating and others.

The thickness of the photosensitive layer is preferably from 5 μm to 100 μm, and more preferably from 10 μm to 35 μm.

<Substrate>

There is no particular restriction on the substrate, and any substance can be appropriately selected, depending on the purpose. Preferable is a substance exhibiting the electric conductivity of $10^{10}$ Ω·cm or less in terms of volume resistance.

There is no particular restriction on the substrate in terms of raw material, shape and dimension. Any of a plate, a drum or a belt shape body can be used. More specifically, usable is that prepared by procedures in which a metal such as aluminum, nickel, chromium, nichrome, copper, gold, silver, and platinum, or an metal oxide such as tin oxide and indium oxide is subjected to vapor deposition or sputtering, and coated on film-shaped or cylindrical plastics or paper, or that prepared by procedures in which a plate of aluminum, aluminum alloy, nickel, or stainless steel, or any of these metals is made into a rough tube by extrusion, drawing or other methods, which is then subjected to surface treatment such as cutting, super finishing or polishing, and shaped into a tube. Further, the endless nickel belt and the endless stainless belt disclosed by JP-A No. 52-36016 can be used as the substrate.

In addition to the above-described substrate, usable are those in which electric conductive powder is dispersed into an appropriate binder resin and coated on the substrate, thereby forming an electric conductive layer.

Materials of the electric conductive powder include, for example, carbon black, acetylene black, metal powder such as aluminum, nickel, iron, nichrome, copper, zinc and silver, and metal oxide powder such as electric conductive tin oxide, and ITO. The binder resin includes, for example, a polystyrene resin, styrene/acrylonitrile copolymer, styrene/butadiene copolymer, styrene/anhydrous maleic acid copolymer, polyester resin, poly vinyl chloride resin, vinyl chloride/vinyl acetate copolymer, poly vinyl acetate resin, polyvinylidene chloride resin, polyallylate resin, phenoxy resin, polycarbonate, cellulose acetate resin, ethyl cellulose resin, polyvinyl butyral resin, polyvinyl formal resin, polyvinyl toluene resin, poly-N-vinyl carbazole resin, acryl resin, silicone resin, epoxy resin, melamine resin, urethane resin, phenol resin, and alkyd resin.

The electric conductive layer can be formed by coating a solution prepared by dissolving or dispersing the electric conductive powder and a binder resin into a solvent on a substrate. The solvent includes, for example, tetrahydrofuran, dichloromethane, methyl ethyl ketone and toluene.

Such a substrate is also preferable that is prepared by procedures in which a heat shrinkable tube manufactured by allowing the electric conductive powder to be contained into polyvinyl chloride resin, polypropylene resin, polyester resin, polystyrene resin, polyvinylidene chloride resin, polyethylene resin, chlorinated rubber or polytetrafluoroethylene fluororesin is used to form an electric conductive layer on the cylindrical substrate -Under Layer- An under layer may be installed between the substrate and the photosensitive layer, whenever necessary. In general, the under layer contains a resin as a major composition. In view of the fact that the resin has thereon a solvent-coated photosensitive layer, preferable is a resin exhibiting a high solvent resistance to general organic solvents.

The above resin includes, for example, water-soluble resins such as polyvinyl alcohol, casein, and sodium polyacrylate; alcohol-soluble resins such as copolymerized nylon, methoxymethylated nylon; and three-dimensional mesh structure cured resins such as polyurethane resin, melamine resin, phenol resin, alkyd/melamine resin and epoxy resin.

Further, in order to prevent more effects and decrease the remaining electric potential, fine particle pigments of metal oxides such as titanium oxide, silica, alumina, zirconium oxide, tin oxide, and indium oxide may be added to the under layer.

The under layer can be formed by using the same solvent and coating method as those for forming the photosensitive layer. A silane coupling agent, a titanium coupling agent, chrome coupling agent or others can be used as the under layer of the present invention. That in which $Al_2O_3$ is installed by anodic oxidation, and that in which an organic substance such as polyparaxylylene (Barilene) or an inorganic substance such as $SiO_2$, $SnO_2$, $TiO_2$, ITO and $CeO_2$ is installed by a vacuum thin-layer forming method can be favorably used as the under layer. In addition, a known product can be used for this purpose.

There is no particular restriction on the thickness of the under layer, and any thickness can be appropriately selected, depending on the purpose. The thickness is preferably from 0.1 μm to 10 μm and more preferably from 1 μm to 5 μm.

Further, an antioxidant can be added to individual layers, that is, a photosensitive layer, a charge generating layer, a charge transporting layer and an under layer or others in the photoconductor of the present invention in order to improve the environmental resistance, in particular, to prevent a decrease in sensitivity and an increase in remaining electric potential.

The antioxidant includes, for example, phenol compounds, paraphenylene diamines, organic sulfur compounds, and organic phosphorus compounds.

The phenol compounds include, for example, 2,6-di-t-butyl-p-cresol, butylated hydroxy anisole, 2,6-di-t-butyl-4-ethylphenol, stearyl-β-(3,5-di-t-butyl-4-hydroxy phenyl) propionate, 2,2'-methylene-bis-(4-methyl 6-t-butylphenol), 2,2'-methylene-bis-(4-ethyl 6-t-butylphenol), 4,4'-thiobis-(3-methyl 6-t-butylphenol), 4,4'-butylidene-bis-(3-methyl-6-t-butylphenol), 1,1,3-tris-(2-methyl-4-hydroxy-5-t-butylphenyl) butane, 1,3,5-trimethyl-2,4,6-tris (3,5-di-t-butyl-4'-hydroxybenzyl)benzene, tetrakis-[methylene-3-(3', 5'-di-t-butyl-4'-hydroxy phenyl) propionate]methane, bis[3, 3'-bis (4'-hydroxy-3'-t-butyl-phenyl) butylic acid]glycol ester and tocopherols.

The paraphenylene diamines include, for example, N-phenyl-N'-isopropyl-p-phenylene diamine, N,N'-di-sec-butyl-p-phenylene diamine, N-phenyl-N-sec-butyl-p-phenylene dimaine, N,N'-di-isopropyl-p-phenylene diamine, N,N'-dimethyl-N, N'-di-t-butyl-p-phenylene diamine.

The hydroquinones include, for example, 2,5-di-t-octylhydroquinone, 2,6-didodecyl hydroquinone, 2-dodecyl hydroquinone, 2-dodecyl 5-chlorohydroquinone, 2-t-octyl-5-methylhydroquinone, and 2-(2-octadecenyl)-5-methylhydroquinone.

The organic sulfur compounds include, for example, dilauryl-3,3'-thiodipropionate, distearyl-3,3'-thiodipropionate, and ditetradecyl-3,3'-thiodipropionate.

The organic phosphorus compounds include, for example, triphenyl phosphine, tri (nonylphenyl) phosphine, tri(dinonylphenyl) phosphine, tricresyl phosphine, and tri (2,4-dibutyl-phenoxy) phosphine.

These compounds are known as antioxidants for rubber, plastics and oils, and easily available as commercial products.

It is preferable that the antioxidant is added from 0.01% by mass to 10% by mass with respect to a total volume of a layer to which it is added.

The latent electrostatic image can be formed, for example, by uniformly charging the surface of the image support and then effecting exposure according to the image. The image can be formed by using the latent electrostatic image forming unit.

The latent electrostatic image forming unit is provided at least with a charger for charging uniformly the surface of the image support and an exposure device for exposing the surface of the image support according to the image, for example.

The charge is conducted by using, for example, the charger to apply voltage to the surface of the image support.

There is no particular restriction on the charger, and any charger can be appropriately selected, depending on the purpose, including, for example, a contact-type charger known by itself and provided with an electric conductive or a semi-electric conductive roll, brush, film, rubber blade and others, and a non-contact type charger in which corona discharge such as a corotron or scorotron is used.

The exposure can be effected, for example, by using the exposure device to expose the surface of the image support according to an image.

There is no particular restriction on the exposure device, as long as exposure can be effected on the surface of the image support charged by the charger according to an image to be formed. Any exposure device can be appropriately selected, depending on the purpose, including, for example, various types of exposure devices based on a reproduction optical system, a rod lens array system, a laser optical system, and a liquid crystal shutter optical system.

It is noted that a back-exposure method can be employed, in which exposure is effected from the back face of the image support according to an image in the present invention.

-Developing Step and Developing Unit-

The developing step is a step at which the latent electrostatic image is developed by using a toner or a developer to form a visible image.

<Toner>

There is no particular restriction on methods and raw materials for the toner, and any known method or raw material can be appropriately selected, depending on the purpose. Methods for producing the toner include, a grinding classification method as described in the Journal of the Imaging Society of Japan, Vol. 43, No. 1 (2004), a suspension polymerization method, an emulsion polymerization method, and a polymer suspension method in which an oil phase is emulsified, suspended or coagulated in an aqueous medium to form toner host particles.

The grinding method is a method in which, for example, toner materials are melted, kneaded, ground, and classified, thereby obtaining host particles of the toner. It is noted that in the grinding method, in order to make the toner spherical, a mechanical impact force is given to the thus obtained host particles of the toner to control the shape. In this instance, the mechanical impact force can be given to the host particles of the toner by using, for example, apparatuses such as a Hybridizer and Mechanofusion.

In the suspension polymerization method, a coloring agent, a release agent and others are dispersed in an oil-soluble polymerization initiator and a polymerizing monomer, and the thus prepared dispersion is emulsified and dispersed in an aqueous medium containing a surface active agent, a solid dispersing agent and others by an emulsion method to be described later. Thereafter, the resultant is granulated by polymerization reactions and subjected to wet-type treatment, by which inorganic fine particles are attached to the surface of particles of the toner of the present invention. In this instance, it is preferable to treat the toner particles from which the surface active agent and others found in an extra quantity are washed and removed.

For example, acids such as acrylic acid, methacrylic acid, α-cyanoacrylic acid, α-cyanomethacrylic acid, itaconic acid, crotonic acid, fumaric acid, maleic acid and anhydrous maleic acid; acrylamide, methacryl amide, diacetoneacryl amide or these methylol compounds; acrylate or methacrylate having an amino group such as vinyl pyridine, vinyl pyrolidone, vinyl imidazole, ethylene imine, methacrylic acid dimethyl aminoethyl are parially used as the polymerizing monomer, thereby making it possible to introduce a functional group into the surface of toner particles.

A dispersing agent having an acid group or a basic group is selected as the dispersing agent used here, thus making it possible to retain the dispersing agent on the surface of the particles and introduce a functional group thereinto.

In the emulsion polymerization method, a water-soluble polymerization initiator and a polymerizing monomer are emulsified in water by using a surface active agent, and latex is synthesized by an ordinary emulsion and polymerization method. A dispersion in which a coloring agent, a release agent and others are dispersed in an aqueous medium is prepared separately, the dispersion is coagulated to a toner size, and subjected to heating and fusion after mixture, thereby obtaining toner. Thereafter, a wet-type treatment is given to inorganic fine particles to be described later. Latex similar to a monomer usable in the suspension polymerization method is used, by which a functional group can be introduced into the surface of toner particles.

Among other things, the toner is preferably prepared by emulsifying or dispersing the dissolution or the dispersion of toner materials in an aqueous medium to granulate toner in view of high resin selectivity, a great low-temperature fixing property, an excellent granulation property and ease in controlling the particle diameter, particle size distribution and shape.

The dissolution of the toner materials is prepared by dissolving the toner materials in a solvent, and the dispersion of toner materials is prepared by dispersing the toner materials in a solvent.

The toner materials contain at least an active hydrogen group-containing compound, a polymer reactive with the active hydrogen group-containing compound, and an adhesive base material obtained by allowing a binder resin, a release agent, and a coloring agent to react, and also contain other compositions such as resin fine particles and a charge control agent, whenever necessary.

The adhesive base material contains at least an adhesive polymer, which is an adhesive to a recording medium such as paper and obtained by allowing the active hydrogen group-containing compound and the polymer reactive with the active hydrogen group-containing compound to react in the aqueous medium, and also may contain a binder resin appropriately selected from known binder resins.

The volume average particle diameter of the toner is preferably from 3 μm to 8 μm and more preferably from 3 μm to 6 μm. Where the volume average particle diameter is less than 3 μm, there may be found an increased proportion of fine particles of toner with the particle diameter of 1 μm or less, which easily causes an image failure. Where it exceeds 8 μm, it may be difficult to meet the demand for a high-quality electrophotographic image.

The volume average particle diameter can be measured, for example, by using a COULTER COUNTER TA II in size counter manufactured by Coulter Electronics Inc.

The average circularity of the toner is preferably 0.90 or more and more preferably 0.95 or more. Where the average circularity is 0.90 or more, there is found improvement in developing property and transfer property, thereby obtaining a high-quality image.

In this instance, the average circularity of the toner can be measured, for example, by a method of optical detection zone in which a toner-containing suspension is allowed to pass through an imaging-portion detection zone on a flat plate, and a particle image is optically detected by using a CCD camera to make an analysis. The average circularity can be measured, for example, by using a flow-type particle image analyzer FPIA-2100 (manufactured by Sysmex RA Co., Ltd.).

<Developer>

The developer contains at least the toner and also contains other appropriately selected compositions such as a carrier. The developer may be one of a one-component developer and a two-component developer. When used in a high-speed printer, etc., to cope with the improvement in information processing speed in recent years, the two-component developer is preferable in terms of an extended service life.

In the one-component developer in which the toner is used, the particle diameter of the toner is varied to a lesser extent after the toner is balanced, and the toner is adhered on a developing roller as a thin film to a lesser extent, and no toner is melted or bonded on members such as a blade for changing the toner into a thin film. When the one-component developer is used (stirred) for a long time by a developing device, there are provided favorable and stable developing properties to result in a high-quality image. Further, in the two-component developer in which the toner is used, the diameter of the toner contained in the developer is changed to a lesser extent after the toner is balanced for a long time. There are also provided favorable and stable developing properties upon prolonged agitation by the developing device.

There is no particular restriction on the carrier, and any carrier can be appropriately selected, depending on the purpose. It is, however, preferable that the carrier has a core and a resin layer for coating the core.

There is no particular restriction on the material of the core, and any material can be appropriately selected from known materials. Preferable are, for example, a manganese-strontium (Mn—Sr) material with 50 emu/g to 90 emu/g and a manganese-magnesium (Mn—Mg) material with the same value. In terms of securing the image density, preferable are highly magnetized materials such as iron powder (100 emu/g or more) and magnetite (75 emu/g to 120 emu/g). Further, in terms of being advantageous in attaining a high quality image by weakening the collision of toner against an image support at which the toner is raised, preferable are weakly magnetized materials such as a copper-zinc (Cu—Zu) material (30 emu/g to 80 emu/g). They may be used solely or in combination of two or more of them.

The particle diameter of the core is preferably from 10 μm to 200 μm on the basis of the volume average particle diameter (volume average particle diameter ($D_{50}$)), and more preferably from 40 μm to 100 μm.

There is no particular restriction on a material of the resin layer, and any resin can be appropriately selected from known resins, depending on the purpose. The resin includes, for example, amino resin, polyvinyl resin, polystyrene resin, olefin halide resin, polyester resin, polycarbonate resin, polyethylene resin, polyvinyl fluoride resin, polyvinylidene fluoride resin, polytrifluoro ethylene resin, polyhexafluoropropylene resin, copolymer of vinylidene fluoride with acryl monomer, copolymer of vinylidene fluoride with vinyl fluoride, fluoro terpolymers such as terpolymers of non-fluorinated monomer with tetrafluoro ethylene and vinylidene fluoride, and silicone resin. They may be used solely or in combination with two or more of them.

The resin layer may include conductive powder and others, whenever necessary. The conductive powder includes, for example, metal powder, carbon black, titanium oxide, tin oxide, and zinc oxide. The average particle diameter of the conductive powder is preferably 1 μm or lower. Where the average particle diameter exceeds 1 μm, it may be difficult to control the electric resistance.

The resin layer can be formed by procedures in which, for example, the silicone resin or the like is dissolved in a solvent to prepare a coating solution, thereafter, the coating solution is coated uniformly on the surface of the core by a known coating method, and the resultant is dried and printed. The coating method includes, for example, a dipping method, spray method, and brush coating method.

There is no particular restriction on the solvent, and any solvent can be appropriately selected, depending on the purpose. The solvent includes, for example, toluene, xylene, methyl ethyl ketone, methyl isobutyl ketone, CelluSolve, and butylacetate.

There is no particular restriction on the printing, and printing by external heating or that by internal heating is acceptable. The printing can be conducted, for example, by a method of using a stationary-type electric furnace, fluid-type electric furnace, rotary electric furnace and burner or by a method of applying microwaves.

The content of the carrier in the resin layer is preferably from 0.01% by mass to 5.0% by mass.

Where the content is less than 0.01% by mass, it may be impossible to form the resin layer uniformly on the surface of the core. Where the content exceeds 5.0% by mass, the resin layer may be made excessively thick to granulate between carriers, thus resulting in a failure in obtaining uniform carrier particles.

Where the developer is the two-component developer, there is no particular restriction on the content of the carrier in the two-component developer, and any content can be appropriately selected, depending on the purpose. The content is preferably, for example, from 90% by mass to 98% by mass, and more preferably from 93% by mass to 97% by mass.

A mixture ratio of the toner to the carrier in the two-component developer is in general from 1 part by mass to 10.0 parts by mass of toner with respect to 100 parts by mass of the carrier.

The visible image can be formed, for example, by using a toner or a developer to develop the latent electrostatic image. The image can be formed by the developing unit.

There is no particular restriction on the developing unit, as long as an image can be developed by using, for example, the toner or the developer. Any developing unit can be appropriately selected from known units. Preferable is, for example, a developing unit, which accommodates the toner or the developer and has at least a developing device capable of imparting the toner or the developer to a latent electrostatic image in contact therewith or without contact.

The developing device may include a dry-type developing device, a wet-type developing device, a single-color developing device and a multi-color developing device. Preferable is, for example, a device provided with an agitator for agitating frictionally the toner or the developer to effect charge and a rotatable magnet roller.

Inside the developing device, for example, the toner and the carrier are mixed and stirred, and the toner is charged by the resulting friction and kept raised on the surface of the rotating magnet roller, thereby forming a magnetic brush. Since the magnet roller is arranged in the vicinity of the image support, the toner constituting the magnetic brush formed on the surface of the magnet roller is partially moved to the surface of the image support due to an electrical suction force. As a result, the latent electrostatic image is developed by the toner and a visible image is formed on the surface of the image support by the toner.

The developer accommodated in the developing device is a developer which contains the toner. The developer may be a one-component developer or a two-component developer.

-Transfer Step and Transfer Unit-

The transfer step is a step of transferring the visible image to a recording medium. Preferable is an embodiment in which an intermediate transfer member is used to primarily transfer a visible image on the intermediate transfer member, thereafter, the visible image is secondarily transferred to the recording medium. More preferable is an embodiment including a primary transfer step in which two or more color toners or, preferably, a full color toner is used as the toner to transfer a visible image on the intermediate transfer member, thereby forming a composite transfer image and a secondary transfer step in which the composite transfer image is transferred to a recording medium.

The transfer can be conducted, for example, by using a transfer charger to charge the visible image on the image support (photosensitive member). The transfer can be conducted by the transfer unit. It is preferable that the transfer unit is of an embodiment including a primary transfer unit in which a visible image is transferred to an intermediate transfer member to form a composite transfer image and a secondary transfer unit in which the composite transfer image is transferred to a recording medium.

It is noted that there is no particular restriction on the intermediate transfer member, and any transfer member can be appropriately selected from known transfer members, depending on the purpose. Preferable is, for example, a transfer belt or the like.

It is preferable that the transfer units (the primary transfer unit and the secondary transfer unit) are provided at least with a transfer device for peeling the visible image formed on the image support and charging it to the recording medium. The transfer unit may be provided in one unit or two or more units.

The transfer device includes a corona transfer device based on corona discharge, a transfer belt, a transfer roller, a pressure transfer roller, and an adhesive transfer device.

It is noted that the recording medium is in general paper, but there is no particular restriction on the recording medium as long as it is able to transfer an unfixed image after development. Any recording medium can be appropriately selected, depending on the purpose, including a PET base (polyethylene terephthalate base) for OHP (overhead slide).

The fixing step is a step in which a visible image transferred to a recording medium is fixed by using a fixing device. This step may be carried out for every transfer of individual color toners to the recording medium or carried out once at the same time in a state that recording media are stacked so as to correspond to the individual color toners.

There is no particular restriction on the fixing device, and any fixing device can be appropriately selected from known fixing devices, depending on the purpose. Preferable is, for example, a heating/pressure unit. The heating/pressure unit includes a combination of a heating roller with a pressure roller and a combination of a heating roller, a pressure roller and an endless belt.

Preferable heating by the heating/pressure unit is usually from 80° C. to 200° C.

It is noted that, for example, any known optical fixing device may be used together with a fixing step and a fixing unit or in place of them, depending on the purpose of the present invention.

The charge eliminating step is a step of applying an antistatic bias to the image support to eliminate charge and can be favorably conducted by the antistatic unit.

There is no particular restriction on the antistatic unit, as long as it is able to apply an antistatic bias to the image support. Any unit can be appropriately selected from known antistatic devices, including, for example, a charge eliminating lamp.

The cleaning step is a step of removing the toner remaining on the electrophotographic photoconductor and can be conducted favorably by a cleaning unit.

There is no particular restriction on the cleaning unit, as long as it is able to remove the electrophotographic toner remaining on the electrophotographic photoconductor. The cleaning unit can be appropriately selected from known cleaners. Preferable are, for example, a magnetic brush cleaner, an electrostatic brush cleaner, a magnetic roller cleaner, a blade cleaner, a brush cleaner and a web cleaner.

It is noted that such a method can be adopted that a rubbing member is used in place of a cleaning unit to make equal the electric charges of remaining toners, and the toners are collected by a developing roller.

Figure 8:
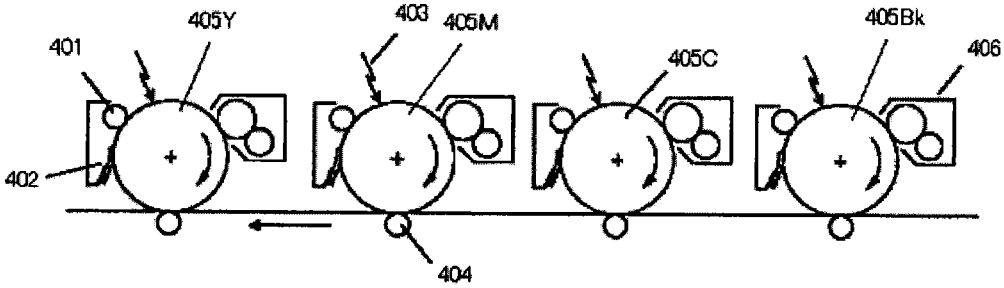
FIG. 8 is a schematic diagram for illustrating still another example of the image forming apparatus of the present invention.

Here, an explanation will be made for a part of one embodiment of a full color image forming apparatus to which the present invention is applied by referring to a schematic diagram given in FIG. 8. The image forming apparatus shown in FIG. 8 is a tandem image forming apparatus, which is provided with photoconductor drums, 405Y, 405M, 405C and 405Bk for the respective colors of yellow (Y), magenta (M), cyan (C) and black (Bk) in place of a photoconductor drum shared by the respective colors. It is also provided with charge brushes 401 for uniformly charging the photoconductor drum, exposure unit 403, developing portions 406 for developing a toner, transfer rollers 404 for transferring the thus developed toner to a recording medium and rubbing members 402 for the respective colors. As described above, since the tandem image forming apparatus is able to form and develop latent images of the respective colors concurrently, it is able to form the images at a much greater speed than a revolving-type image forming apparatus. In the present image forming apparatus, remaining toners after transfer are appropriately made equal by the rubbing members 402 in electric charges, which were once disturbed, temporarily collected at an appropriate bias voltage by the charge brushes 401, again timely returned to the photoconductor drums at an appropriate bias voltage, collected at the developing portions and used again. Therefore, in order to make equal in electric charges of the toners, an appropriate bias voltage and pressure are applied to the rubbing members 402. As described above, the electric charges of remaining toners are made equal by the rubbing members 402 and collected by the developing rollers, thus making it possible to clean toners without using a cleaning blade.

The recycle step is a step in which the electrophotographic toner removed by the cleaning step is recycled by the developing unit. This step can be favorably conducted by the recycle unit.

There is no particular restriction on the recycle unit, including a known transfer unit.

The control step is a step of controlling the above-described individual steps and can be favorably conducted by the control unit.

There is no particular restriction on the control unit, as long as it is able to control actions of the individual units. Any control unit can be appropriately selected, depending on the purpose, including, for example, devices such as a sequencer and a computer.

Here, an explanation will be made for an image forming apparatus used in the present invention by referring to the drawings. It is noted that in each drawing, the photoconductor is a photoconductor which meets the requirements of the present invention.

Figure 6:
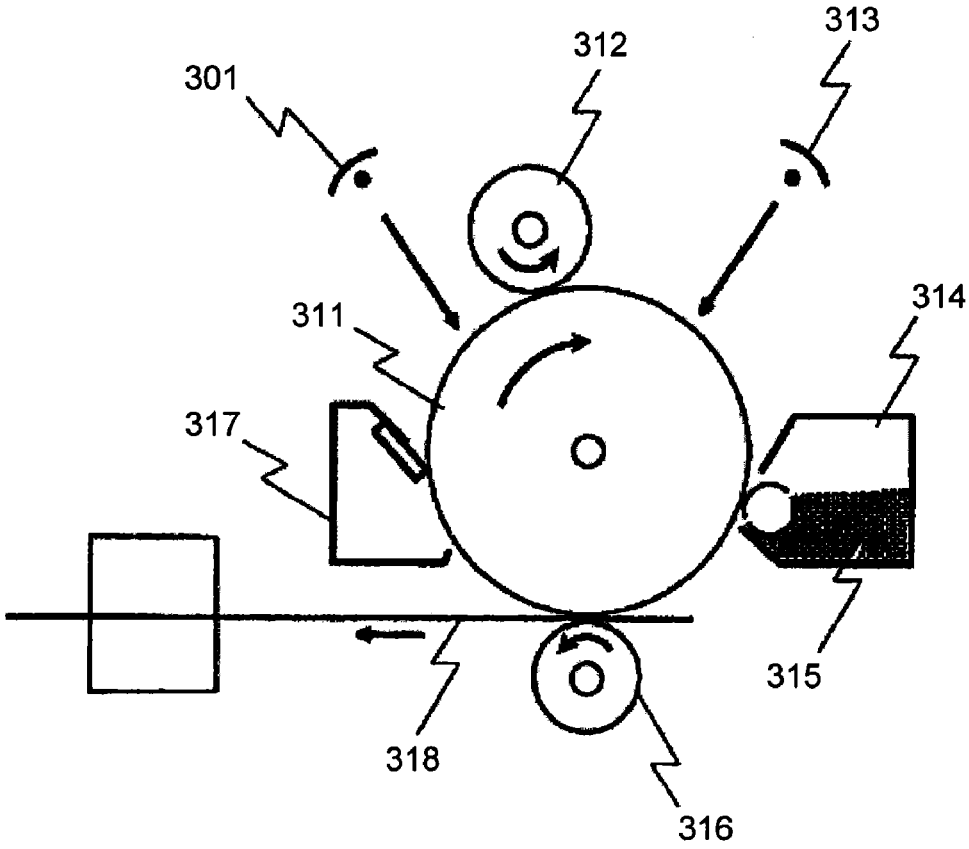
FIG. 6 is a schematic diagram for illustrating one example of the image forming apparatus of the present invention.

FIG. 6 is a schematic diagram for explaining one example of the image forming apparatus of the present invention, and modified examples to be explained later will be also included in the present invention.

In FIG. 6, the photoconductor 311 is a photoconductor which meets the requirements of the present invention.

The photoconductor 311 is in a drum shape but may be available in a sheet shape or an endless belt shape.

The charge unit 312 includes any units such as a corotron, a scorotron, a solid charger (solid state charger), and a charge roller.

The transfer unit 316 may in general include the above charger. Effective is that in which a transfer charger and a separation charger are used in combination.

Further, reference numeral 313 denotes an exposure unit, and a laser diode (LD) and a light emitting diode (LED) can be used for this purpose. Still further, depending on the case, in order to radiate only light of a desired wavelength region, various types of filters can be used such as a sharp cut filter, bandpass filter, near-infrared cut filter, dichroic filter, interference filter and color conversion filter.

Reference numeral 301 denotes a charge eliminating unit, which will be used whenever necessary. A light source includes any light emitting products such as fluorescent lamp, tungsten lamp, halogen lamp, mercury lamp, sodium lamp, light emitting diode (LED), laser diode (LD), and electroluminescence (EL).

A toner 315 developed on a photoconductor by the developing unit 314 is transferred to a recording medium 318. However, all the toner 315 is not transferred, some of which remains on the photoconductor. The remaining toner is removed from the photoconductor by the cleaning unit 317. The cleaning unit includes a rubber-made cleaning blade and various types of a brush such as a fur brush.

When the electrophotographic photoconductor is charged positively or negatively and subjected to image exposure, a positive (or a negative) latent electrostatic image is formed on the surface of the photoconductor. When the thus formed image is developed by a negatively (or a positively) polarized toner (voltage-detecting fine particles), a positive image can be obtained. Further, when the image is developed by a positively (or a negatively) polarized toner, a negative image can be obtained. A known method is applicable to the developing unit and also to the antistatic unit.

Figure 7:
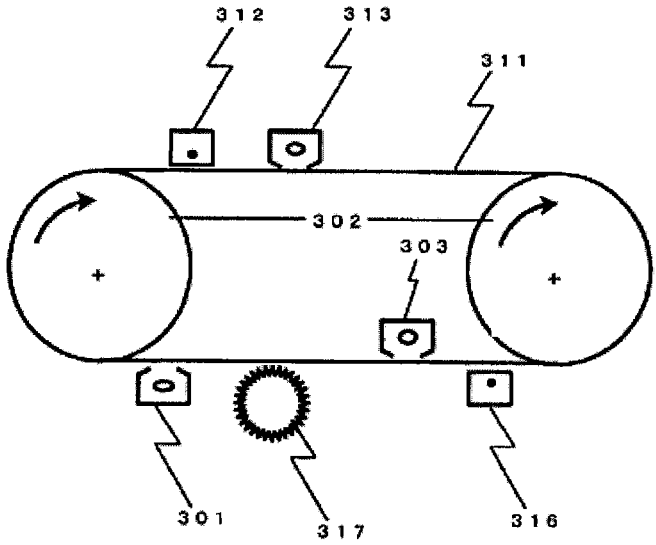
FIG. 7 is a schematic diagram for illustrating another example of the image forming apparatus of the present invention.

FIG. 7 exemplifies another example of the image forming apparatus of the present invention. In FIG. 7, the photoconductor 311 is an electrophotographic photoconductor which meets the requirements of the present invention and in an endless belt shape.

The apparatus is driven by a driving unit 302, and an image is charged by a charge unit 312, exposed and developed (not illustrated) by an exposure unit 313, transferred by a transfer unit 316, subjected to exposure before cleaning by a pre-cleaning exposure unit 303, subjected to cleaning by a cleaning unit 317, and eliminated for electricity by a charge eliminating unit 301, the procedures of which are conducted repeatedly. In FIG. 7, light radiation, which is an exposure before cleaning, is conducted from the substrate of the photoconductor (in this instance, the substrate is translucent).

Figure 10:
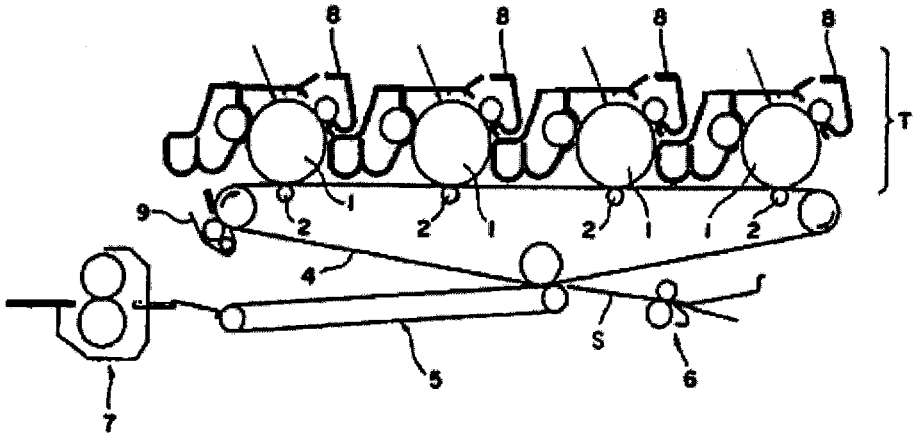
FIG. 10 is a partial schematic diagram for illustrating another example of the image forming element of the tandem image forming apparatus of the present invention.

In the exposure unit 313 given in FIG. 10 as well, a light source includes a laser diode (LD) and a light emitting diode (LED). Further, depending on the case, in order to radiate only light of a desired wavelength region, various types of filters can be used such as a sharp cut filter, bandpass filter, near-infrared cut filter, dichroic filter, interference filter and color conversion filter.

The above-described image forming apparatus exemplifies an embodiment of the present invention, and other embodiments are also acceptable. For example, in FIG. 10, exposure before cleaning is effected from the substrate, but may be effected from the photosensitive layer. Further, an image may be exposed and antistatic light may be radiated from the substrate. On the other hand, the image exposure, exposure before cleaning, and antistatic exposure are illustrated in a light radiation step. However, exposure before transfer, preliminary exposure of image exposure and other known light radiation steps can be provided to radiate light on the photoconductor.

The above-described image forming apparatus may be fixed and assembled into a copying machine, a facsimile machine or a printer. Alternatively, it may be assembled into these devices as a process cartridge. The process cartridge is a device (component) which is provided with a built-in photoconductor and inclusive of a charge unit, an exposure unit, a developing unit, a transfer unit, a cleaning unit and a charge eliminating unit. The process cartridge is available in a variety of shapes. The process cartridge is attached in a removable manner and easy in maintenance.

Figure 13:
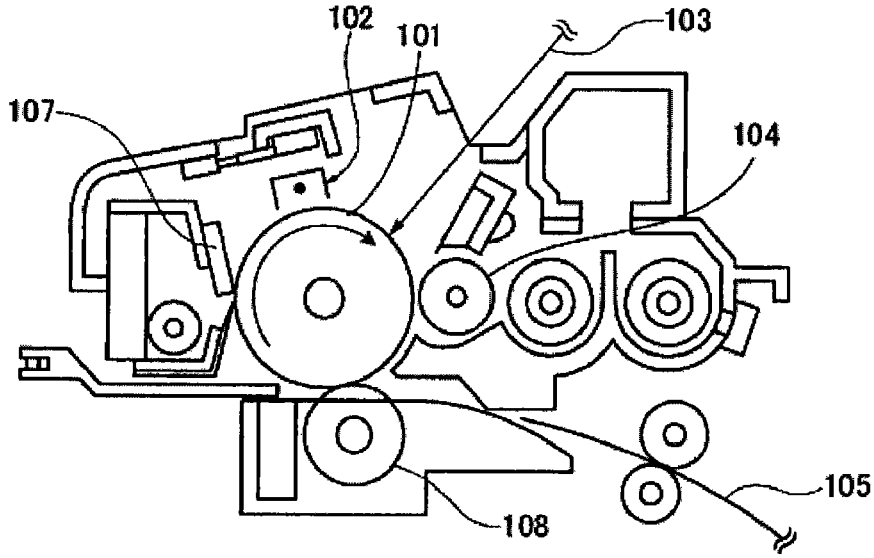
FIG. 13 is a schematic diagram for illustrating one example of a process cartridge loaded on the image forming apparatus of the present invention.

For example, as shown in FIG. 13, the process cartridge is that which is provided with a built-in photoconductor 101 and also inclusive of a charge unit 102, a developing unit 104, a transfer unit 108, a cleaning unit 107 and still other units, if necessary. In FIG. 13, reference numerals 103 and 105 respectively denote exposure by an exposure unit and a recording medium.

The same components as those described above can be used as the photoconductor 101. Any charging material can be used as the charge unit 102.

Here, an explanation will be made for an image forming process by the process cartridge given in FIG. 13. The photoconductor 101 is charged by the charge unit 102 and exposed by the exposure unit 103 (not illustrated), while rotating in a direction given by the arrow, thereby forming a latent electrostatic image corresponding to an exposed image on the surface thereof. The latent electrostatic image is subjected to toner development by the developing unit 104 and the toner development is transferred to a recording medium 105 by the transfer unit 108 and printed out. Then, the surface of the photoconductor after image transfer is cleaned by the cleaning unit 107 and also eliminated for electricity by a charge eliminating unit (not illustrated), the procedures of which are repeated.

Figure 9:
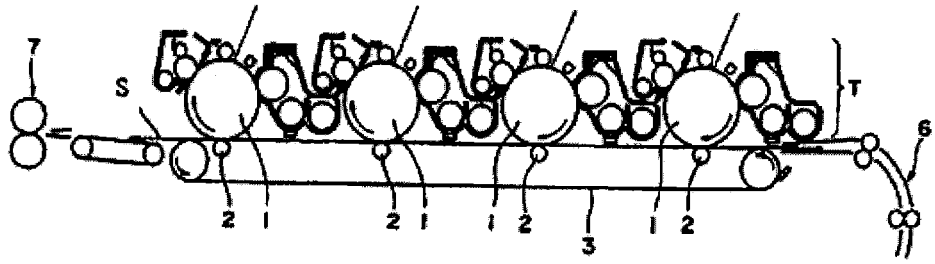
FIG. 9 is a view partially illustrating one example of an image forming element of the tandem image forming apparatus of the present invention.

A tandem image forming apparatus based on an electrophotographic process, which executes an image forming method of the present invention by using the image forming apparatus of the present invention, is available in a direct transfer apparatus in which images on individual photoconductors 1 are sequentially transferred by a transfer device 2 to a sheet S conveyed by a sheet transfer belt 3, as shown in FIG. 9, and an indirect transfer apparatus in which images on individual photoconductors 1 are sequentially transferred by a primary transfer device 2 once to an intermediate transfer member 4 and the images on the intermediate transfer member 4 are altogether transferred by a secondary transfer device 5 to a sheet S also as shown in FIG. 10. Although the transfer device 5 is a transfer/conveyance belt, it is also available in a roller shape.

When the direct transfer apparatus is compared with the indirect transfer apparatus, the former is required to arrange a sheet feeding device 6 upstream from a tandem image forming apparatus T on which the photoconductors 1 are arrayed and a fixing device 7 downstream therefrom and expanded in a sheet conveying direction, which is disadvantageous. On the contrary, the latter is able to establish a secondary transfer position relatively arbitrarily. The sheet feeding device 6 and the fixing device 7 can be arranged so as to be placed on the tandem image forming apparatus T and miniaturized, which is advantageous.

Further, in order not to be expanded in a sheet conveying direction, the former is required to arrange the fixing device 7 in close proximity to the tandem image forming apparatus T. As a result, it is unable to arrange a fixing device 7 with ample room that the sheet s can be flexible, thereby there is found a disadvantage that the fixing device 7 is likely to affect an image formation upstream therefrom due to a collision when the leading end of the sheet s enters the fixing device 7 (apparent particularly when the sheet is thick) and a difference between the speed at which the sheet passes through the fixing device 7 and the speed at which the sheet is conveyed by a transfer belt. On the contrary, the latter is able to arrange the fixing device 7 in such a sufficient room that the sheet s can be flexible, thereby the fixing device 7 hardly affects an image formation.

As described so far, of these tandem image forming apparatuses based on electrophotographic process, an indirect type apparatus has now particularly become the focus of attention.

Then, in the image forming apparatus based on this type of color electrophotographic process, as shown in FIG. 10, toners remaining on the photoconductor 1 after primary transfer are eliminated by a photoconductor cleaning device 8 to clean the surface of the photoconductor 1 and made ready for forming an image again. Further, the toners remaining on the intermediate transfer member 4 after secondary transfer are eliminated by an intermediate transfer member cleaning device 9 to clean the surface of the intermediate transfer member 4 and made ready for forming an image again.

Figure 11:
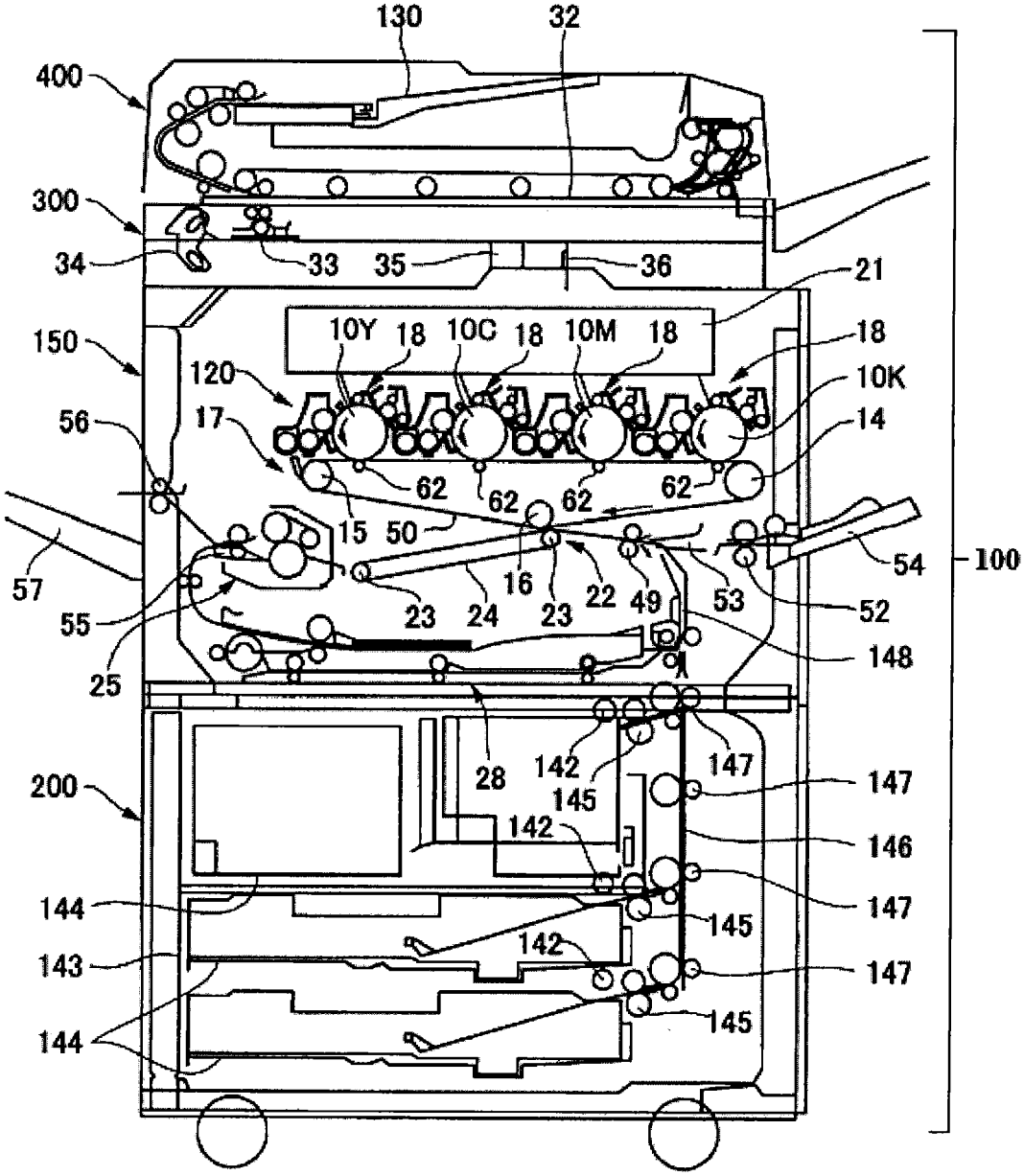
FIG. 11 is a whole schematic diagram for illustrating still another example of the tandem image forming apparatus of the present invention.

The tandem image forming apparatus 100 given in FIG. 11 is a tandem color-image forming apparatus. The tandem image forming apparatus 100 is provided with a copying device main body 150, a sheet feeding table 200, a scanner 300 and an automatic document feeder (ADF) 400.

The copying device main body 150 is provided with an endless-belt type intermediate transfer member 50 at the center. Then, the intermediate transfer member 50 is extended by supporting rollers 14, 15 and 16 so as to be rotated in a clockwise to direction as shown in FIG. 11. An intermediate transfer member cleaning device 17 for eliminating toners remaining on the intermediate transfer member 50 is arranged in the vicinity of the supporting roller 15. A tandem developing device 120 in which four image forming units 18 (yellow, cyan, magenta and black) are arranged side by side so as to oppose each other are arranged in a conveying direction on the intermediate transfer member 50 extended by the supporting rollers 14 and 15. An exposure device 21 is arranged in the vicinity of the tandem developing device 120. A secondary transfer device 22 is arranged on a side opposite to the side at which the tandem developing device 120 is arranged on the intermediate transfer member 50. In the secondary transfer device 22, the secondary transfer belt 24, which is an endless belt, is extended by a pair of rollers 23. Transfer paper conveyed on the secondary transfer belt 24 and the intermediate transfer member 50 are in contact with each other. A fixing device 25 is arranged in the vicinity of the secondary transfer device 22.

It is noted that a sheet inverting device 28 for inverting the transfer paper to form an image on both faces of the transfer paper is arranged in the vicinity of the secondary transfer device 22 and the fixing device 25 in the tandem image forming apparatus 100.

Next, an explanation will be made for a full-color image formation (color copy) by using the tandem developing device 120. In other words, at first, documents are set on the document counter 130 of the automatic document feeder (ADF), or the automatic document feeder 400 is opened to set documents on the contact glass 32 of the scanner 300 and the automatic document feeder 400 is closed.

Depressing a start switch (not shown) will actuate a scanner 300 after documents are conveyed and moved to a contact glass 32 when the documents are set on the automatic document feeder 400, whereas actuating the scanner immediately when the documents are set on the contact glass 32, thereby allows a first traveling member 33 and a second traveling body 34 to travel. In this instance, light from a light source is radiated from the first traveling member 33 and also light reflected from the surface of the documents is reflected on a mirror of the second traveling member 34, and received by a reading sensor 36 through an imaging lens 35, by which color documents (color images) are read to give image information of black, yellow, magenta and cyan.

Figure 12:
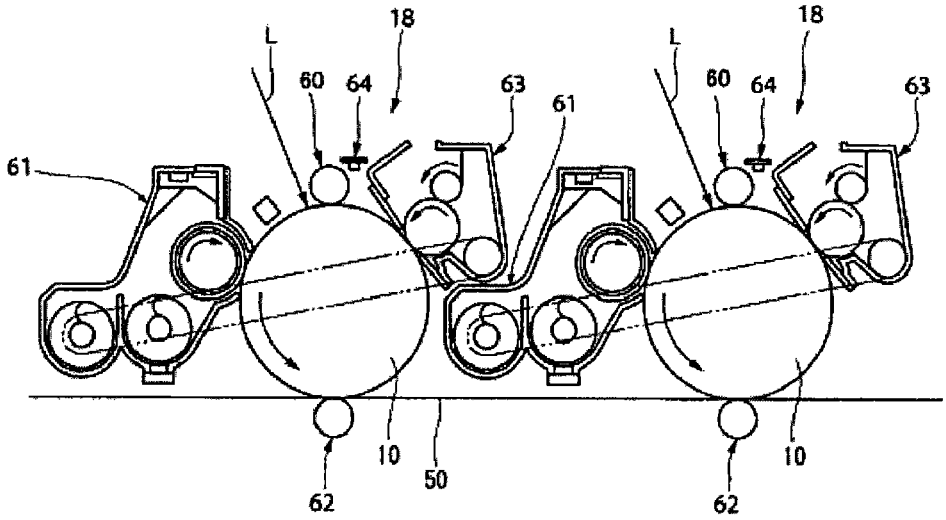
FIG. 12 is a partially enlarged view of FIG. 11.

Then, the image information of black, yellow, magenta and cyan is sent to each of the image forming units 18 (black image forming unit, yellow image forming unit, magenta image forming unit and cyan image forming unit) in the tandem developing device 120, thereby forming toner images of black, yellow, magenta and cyan by each of the image forming units. In other words, as shown in FIG. 12, the image forming units 18 (black image forming unit, yellow image forming unit, magenta image forming unit and cyan image forming unit) in the tandem developing device 120 are respectively provided with photoconductors 10 (black photoconductor 10K, yellow photoconductor 10Y, magenta photoconductor 10M and cyan photoconductor 10C), an charger 60 for uniformly charging the photoconductor, an exposure device of exposing the photoconductor according to an image corresponding to each of the color images on the basis of each color image information (L given in FIG. 12) to form a latent electrostatic image corresponding to each color image on the photoconductor, a developing device 61 for developing the latent electrostatic image by using each color toner (black toner, yellow toner, magenta toner and cyan toner) to form a toner image by each color toner, a transfer charger 62 for transferring the toner image on the intermediate transfer member 50, a photoconductor cleaning device 63 and an antistatic device 64. Each of the single images (black image, yellow image, magenta image and cyan image) can be formed on the basis of the respective color image information. The thus formed black image, the yellow image, the magenta image and the cyan image are sequentially transferred (primary transfer) on the intermediate transfer member 50 rotated and moved by the supporting rollers 14, 15 and 16, respectively as a black image formed on the black photoconductor 10K, a yellow image formed on the yellow photoconductor 10Y, a magenta image formed on the magenta photoconductor 10M, and a cyan image formed on the cyan photoconductor 10C. Then, the black image, the yellow image, the magenta image, and the cyan image are superimposed on the intermediate transfer member 50, thereby forming a synthesized color image (color transfer image).

On the other hand, in the sheet feeding table 200, one of sheet feeding rollers 142 is selectively rotated to deliver sheets (recording paper) from one of the sheet feeding cassettes 144 provided in a multi-stage manner on a paper bank 143. The thus delivered sheets are separated one by one by a separation roller 145 and sent to a sheet feeding channel 146. Then, the sheets are conveyed by a conveying roller 147 and guided into a sheet feeding channel 148 inside a copying machine main body 150 and stopped by hitting them against a resist roller 49. Alternatively, the sheet feeding roller is rotated to deliver sheets (recording paper) on a manual tray 54. The thus delivered sheets are separated one by one by the separation roller 52 and placed into a manual sheet feeding channel 53 and stopped in a similar manner by hitting them against the resist roller 49. It is noted that the resist roller 49 is in general grounded before use, but in this instance, the roller may be used, with bias being applied, in view of removing dust on the sheets. Then, the resist roller 49 is rotated in synchronization with a synthesized color image (color transfer image) synthesized on an intermediate transfer member 50, by which the sheets (recording paper) are sent between the intermediate transfer member 50 and a secondary transfer device 22. The synthesized color image (color transfer image) is transferred (secondary transfer) to the sheets (recording paper) by the secondary transfer device 22, thereby forming a color image on the sheets (recording paper). It is noted that toners remaining on the intermediate transfer member 50 after transfer of the image are cleaned by an intermediate transfer member cleaning device 17.

The sheets (recording paper) on which a color image is transferred and formed are conveyed by the secondary transfer device 22 and sent to a fixing device 25. Then, the synthesized color image (color transfer image) is fixed on the sheets (recording paper) by the fixing device 25 thermally under pressure. Thereafter, the sheets (recording paper) are changed over by a change-over pawl 55 and discharged by a discharge roller 56 and stacked on a discharge tray 57. Alternatively, the sheets are changed over by the change-over pawl 55, inverted by the sheet inverting device 28, and again guided to a transfer position to record an image on the back face. Thereafter, they are discharged by the discharge roller 56 and stacked on the discharge tray 57.

The image forming method and the image forming apparatus of the present invention are high in resistance, able to form a full-color image stable in quality after repeated use and also able to form a full-color image quickly at low cost.

The present invention is able to solve the conventional problems and also provide an image forming apparatus and an image forming method free of abnormal images, particularly afterimages on prolonged repeated use and also excellent in durability and stable in image quality.

EXAMPLES

Hereinafter, the present invention will be further described in detail with reference to specific Examples, however, the present invention will not limited to the disclosed Examples.

Production Example 1

-Preparation of Photoconductor 1-

In a ball mill device, 27 parts by mass of an X-metal free phthalocyanine (FASTOGEN BLUE 8120BS manufactured by Dainippon Ink and Chemicals Inc.) as a charge generating material was dispersed together with 1,015 parts by mass of cyclohexanone for 120 minutes to prepare a charge generating material dispersion (1).

Separately to the above, titanyl phthalocyanine was prepared according to the method described in JP-A No. 2001-19871. Specifically, 29.2 g of 1,3-diiminoiso-indolin and 200 mL of sulfolane were mixed, and then 20.4 g of titanium tetrabutoxide was added dropwise to the mixture in a nitrogen atmosphere. After completion of the drop, the mixture was gradually heated up to 180° C. and stirred for 5 hours to react it while maintaining the reaction temperature at 170° C. to 180° C. After completion of the reaction, the resultant was naturally cooled to obtain a deposit, and then the deposit was filtered and washed with chloroform until the powder was turned blue. Then, the resultant was washed several times with methanol, further washed several times with hot water at 80° C. and thereafter dried to obtain a titanyl phthalocyanine in a crude form. The thus obtained crude titanyl phthalocyanine was dissolved in 20 volumes of concentrated sulfuric acid and was added dropwise, and the resultant mixture was added dropwise to 100 volumes of iced water with stirring. Deposited crystal was filtered and then washed with water repeatedly until a wash fluid was neutralized (ion exchange water after washing was 6.8 in pH), by which a titanyl phthalocyanine pigment was obtained as wet cake (water paste) to thereby obtain a wet cake water paste). Forty grams of the thus obtained wet cake (water paste) was added to 200 g of tetrahydrofuran and stirred for 4 hours. The resultant was filtered and dried to obtain a titanyl phthalocyanine powder.

The concentration of the solid content of the thus obtained wet cake was 15% by mass. A crystal conversion solvent was 33 times in mass ratio with respect to the wet cake.

The thus obtained titanyl phthalocyanine powder was analyzed by X-ray diffraction spectrum under the following conditions. It was found that a crystalline titanyl phthalocyanine powder was obtained which had a maximum diffraction peak of at least 27.2° as a diffraction peak (±0.2°) of the Bragg angle 2θ with respect to characteristic X-rays of Cu-Kα (wavelength of 1.542 Å), having major peaks at 9.4°, 9.6°, 24.0°, and also having a peak at 7.3° as a diffraction peak on the lowest angle side but not having a peak between the peak of 7.3° and that of 9.4°.

Figure 14:
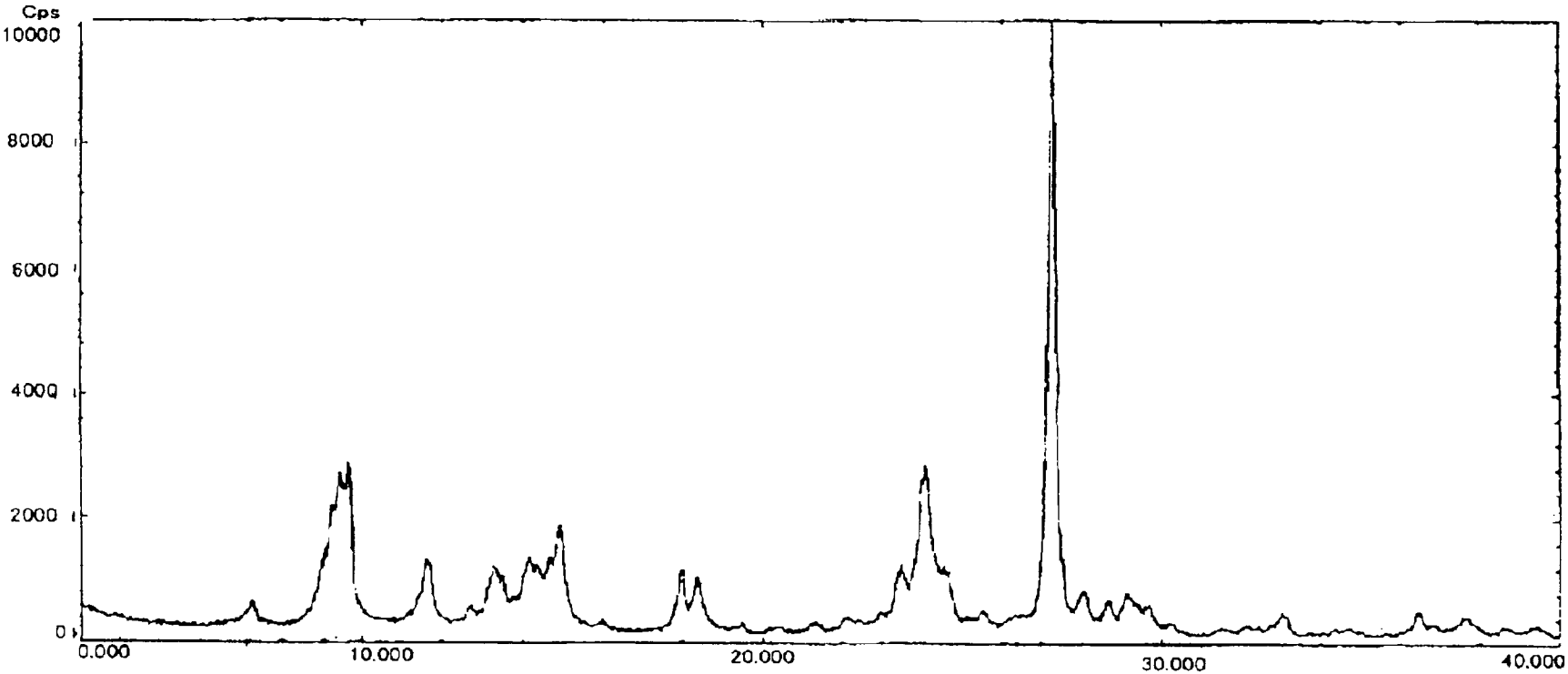
FIG. 14 is an X-ray diffraction spectrum of titanyl phthalocyanine synthesized in Production Example 1.

FIG. 14 shows the result of X-ray diffraction analysis.

[Conditions of X-Ray Diffraction Spectrum Measurement]

X-ray tube: Cu
voltage: 50 kV
electric current: 30 mA
scanning speed: 2°/minute
scanning range: 3° to 40°
time constant: 2 seconds Next, 34 parts by mass of the thus obtained titanyl phthalocyanine was dispersed for 70 minutes together with 1054 parts by mass of cyclohexanone in a ball mill to obtain a charge generating material dispersion (2). It was noted that the titanyl phthalocyanine in the dispersion was measured as to average particle size by using CAPA 700, a particle size distribution measuring instrument manufactured by Horiba Ltd., and the titanyl phthalocyanine had an average particle size of 0.31 μm.

Then, 51 parts by mass of a polycarbonate resin (Z-type polycarbonate, viscosity average molecular weight=50,000, manufactured by Teijin Chemicals Ltd.), 26 parts by mass of an electron transporting material represented by the following Structural Formula (1), 33 parts by mass of a positive-hole transporting substance represented by the following Structural Formula (A), and 0.1 part by mass of silicone oil (KF50-100CS, manufactured by Shin-Etsu Chemical Co., Ltd.) were dissolved in 355 parts by mass of tetrahydrofuran, and to the dispersion, 7.54 parts by mass of the charge generating material dispersion (1), and 56.27 parts by mass of the charge generating material dispersion (2) were added and stirred to prepare a photosensitive layer coating solution.

Structural Formula (1)

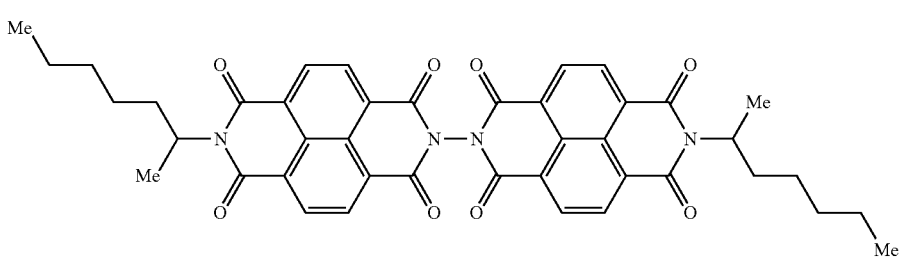

In the Structural Formula (1), Me represents a methyl group.

Structural Formula (A)

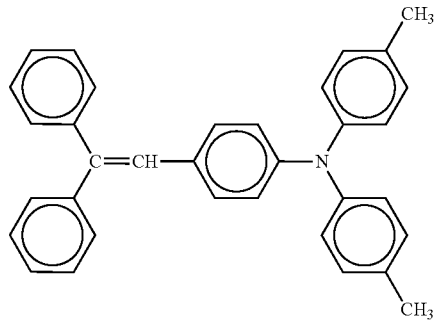

Next, the photosensitive layer coating solution was applied over the surface of a 100 mm-across 360 mm-long aluminum drum by immersion coating to form a 29 μm-thick photosensitive layer while controlling the coating speed. The photosensitive layer was dried at 120° C. for 15 minutes to prepare the photoconductor 1.

Production Example 2

-Preparation of Photoconductor 2-

A photoconductor 2 was prepared in the same manner as in Production Example 1 with the exception that the charge generating material dispersion (1) and the charge generating material dispersion (2) were added respectively at 0.38 parts by is mass and 62.21 parts by mass and stirred to prepare a photosensitive layer coating solution.

Production Example 3

-Preparation of Photoconductor 3-

A photoconductor 3 was prepared in the same manner as in Production Example 1 with the exception that the charge generating material dispersion (1) and the charge generating material dispersion (2) were added respectively at 0.75 parts by mass and 61.9 parts by mass and stirred to prepare a photosensitive layer coating solution.

Production Example 4

-Preparation of Photoconductor 4-

A photoconductor 4 was prepared in the same manner as in Production Example 1 with the exception that the charge generating material dispersion (1) and the charge generating material dispersion (2) were added respectively at 6.03 parts by mass and 57.52 parts by mass and stirred to prepare a photosensitive layer coating solution.

Production Example 5

-Preparation of Photoconductor 5-

A photoconductor 5 was prepared in the same manner as in Production Example 1 with the exception that the charge generating material dispersion (1) and the charge generating material dispersion (2) were added respectively at 9.05 parts by mass and 55.02 parts by mass and stirred to prepare a photosensitive layer coating solution.

Production Example 6

-Preparation of Photoconductor 6-

A photoconductor 6 was prepared in the same manner as in Production Example 1 with the exception that the charge generating material dispersion (1) and the charge generating material dispersion (2) were added respectively at 15.08 parts by mass and 50.02 parts by mass and stirred to prepare a photosensitive layer coating solution.

Production Example 7

-Preparation of Photoconductor 7-

A photoconductor 7 was prepared in the same manner as in Production Example 1 with the exception that the charge generating material dispersion (1) and the charge generating material dispersion (2) were added respectively at 22.62 parts by mass and 43.77 parts by mass and stirred to prepare a photosensitive layer coating solution.

Production Example 8

-Preparation of Photoconductor 8-

A photoconductor 8 was prepared in the same manner as in Production Example 1 with the exception that the charge generating material dispersion (1) and the charge generating material dispersion (2) were added respectively at 37.7 parts by mass and 31.26 parts by mass and stirred to prepare a photosensitive layer coating solution.

Production Example 9

Preparation of Photoconductor 9-

-A photoconductor 9 was prepared in the same manner as in Production Example 1 with the exception that the charge generating material dispersion (1) and the charge generating material dispersion (2) were added respectively at 39.21 parts by mass and 30.01 parts by mass and stirred to prepare a photosensitive layer coating solution.

Production Example 10

-Preparation of Photoconductor 10-

In Production Example 10, 6.83 parts by mass of an X-metal free phthalocyanine (FASTOGEN BLUE 8120BS) and 61.48 parts by mass of the titanyl phthalocyanine powder prepared according to JP-A No. 2001-19871 were dispersed as a charge generating material together with 2320.15 parts by mass of cyclohexanone for 80 minutes in a ball mill to prepare a charge generating material dispersion (3).

Separately to the above treatment, a photoconductor 10 was prepared in the same manner as in Production Example 1 with the exception that 51 parts by mass of a polycarbonate resin (Z-type polycarbonate, viscosity average molecular weight=50,000, manufactured by Teijin Chemicals Ltd.), 26 parts by mass of an electron transporting material represented by the Structural Formula (1), 33 parts by mass of a positive-hole transporting substance represented by the Structural Formula (A), and 0.1 part by mass pf silicone oil (KF50-100CS, manufactured by Shin-Etsu Chemical Co., Ltd.) were dissolved in 355 parts by mass of tetrahydrofuran, and then to the dispersion, 68.31 parts by mass of the charge generating material dispersion (3) was added and stirred to prepare a photosensitive layer coating solution.

Production Example 11

-Preparation of Photoconductor 11-

A photoconductor 11 was prepared in the same manner as in Production Example 1 with the exception that an electron transporting material represented by the following Structural Formula (2) was used in place of an electron transporting material represented by the Structural Formula (1) used as a photosensitive layer coating solution.

Structural Formula (2)

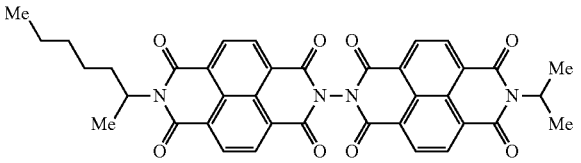

In the Structural Formula (2), Me represents a methyl group.

Production Example 12

-Preparation of photoconductor 12-

A photoconductor 12 was prepared in the same manner as in Production Example 1 with the exception that an electron transporting material represented by the following Structural Formula (3) was used in place of an electron transporting material represented by the Structural Formula (1) used as a photosensitive layer coating solution.

Structural Formula (3)

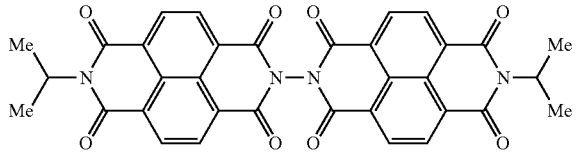

In the Structural Formula (3), Me represents a methyl group.

Production Example 13

-Preparation of Photoconductor 13-

A photoconductor 13 was prepared in the same manner as in Production Example 1 with the exception that an electron transporting material represented by the following Structural Formula (4) was used in place of an electron transporting material represented by the Structural Formula (1) used as a photosensitive layer coating solution.

Structural Formula (4)

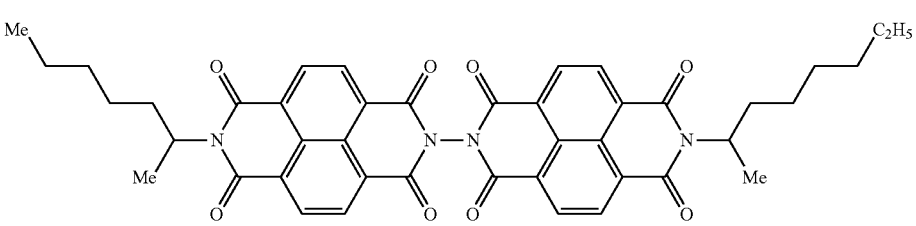

In the Structural Formula (4), Me represents a methyl group.

Production Example 14

-Preparation of Photoconductor 14-

A photoconductor 14 was prepared in the same manner as in Production Example 1 with the exception that an electron transporting material represented by the following Structural Formula (5) was used in place of an electron transporting material represented by the Structural Formula (1) used as a photosensitive layer coating solution.

Structural Formula (5)

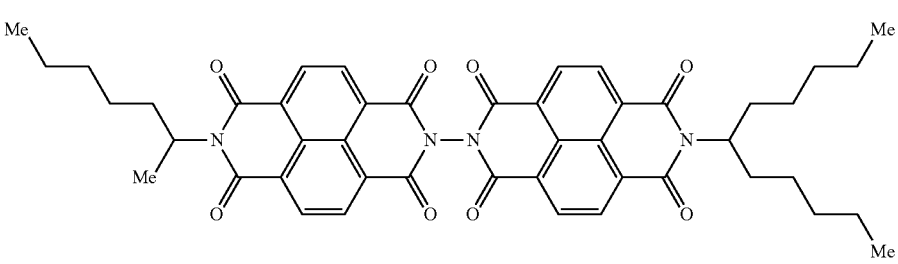

In the Structural Formula (5), Me represents a methyl group.

Production Example 15

-Preparation of Photoconductor 15-

A photoconductor 15 was prepared in the same manner as in Production Example 1 with the exception that an electron transporting material represented by the following Structural Formula (6) was used in place of an electron transporting material represented by the Structural Formula (1) used as a photosensitive layer coating solution.

Structural Formula (6)

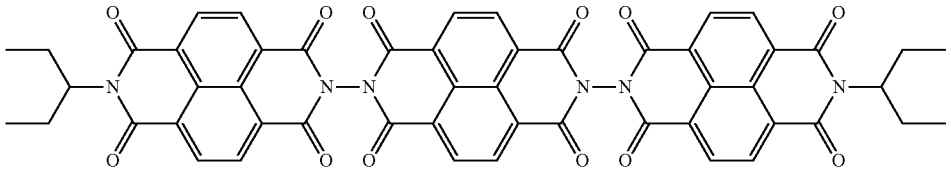

In the Structural Formula (6), terminal groups on both ends represent Me (methyl group).

Production Example 16

-Preparation of Photoconductor 16-

A photoconductor 16 was prepared in the same manner as in Production Example 1 with the exception that an electron transporting material represented by the following Structural Formula (7) was used in place of an electron transporting material represented by the Structural Formula (1) used as a photosensitive layer coating solution.

Structural Formula (7)

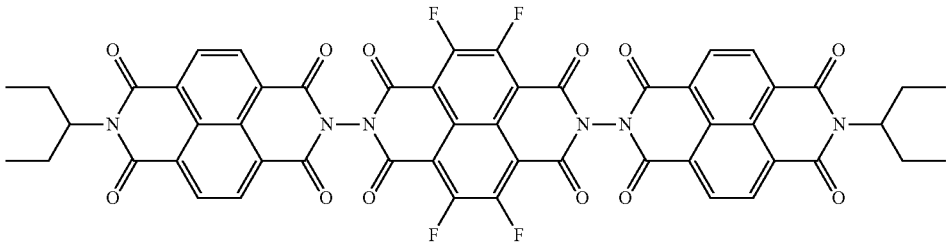

In the Structural Formula (7), terminal groups on both ends represent Me (methyl group).

Production Example 17

-Preparation of Photoconductor 17-

A photoconductor 17 was prepared in the same manner as in Production Example 1 with the exception that an electron transporting material represented by the following Structural Formula (8) was used in place of an electron transporting material represented by the Structural Formula (1) used as a photosensitive layer coating solution.

Structural Formula (8)

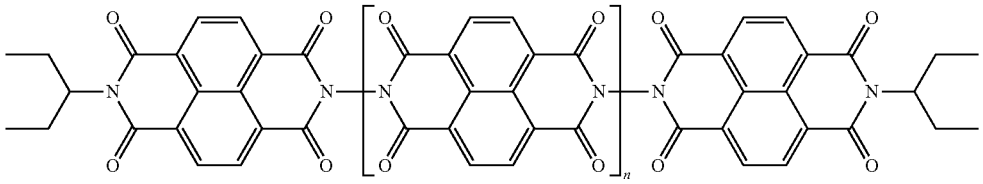

In the Structural Formula (8), terminal groups on both ends represent Me (methyl group), and "n" represents an integer of 1 to 100.

Production Example 18

-Preparation of Photoconductor 18-

A photoconductor 18 was prepared in the same manner as in Production Example 1 with the exception that a polyallylate resin (U polymer: U-100, manufactured by Unitika Ltd.) was used in place of an polycarbonate resin used as a photosensitive layer coating solution.

Production Example 19

-Preparation of Photoconductor 19-

A photoconductor 19 was prepared in the same manner as in Production Example 1 with the exception that a positive-hole transporting substance represented by the following Structural Formula (B) was used in place of a positive-hole transporting substance represented by the Structural Formula (A) used as a photosensitive layer coating solution.

Structural Formula (B)

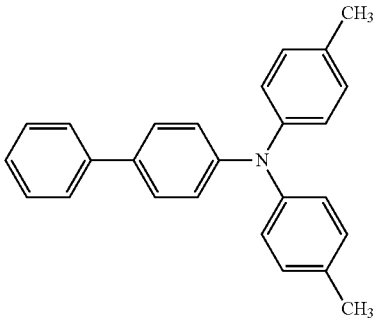

Comparative Production Example 1

-Preparation of Comparative Photoconductor 1-

A comparative photoconductor 1 was prepared in the same manner as in Production Example 1 with the exception that an electron transporting material represented by the following Structural Formula (C) was used in place of an electron transporting material represented by the Structural Formula (1) used as a photosensitive layer coating solution.

Structural Formula (C)

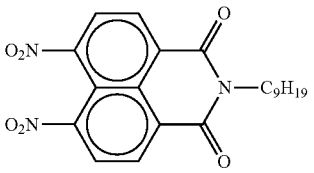

Comparative Production Example 2

-Preparation of Comparative Photoconductor 2-

A comparative photoconductor 2 was prepared in the same manner as in Production Example 1 with the exception that an electron transporting material represented by the following Structural Formula (D) was used in place of an electron transporting material represented by the Structural Formula (1) used as a photosensitive layer coating solution.

Structural Formula (D)

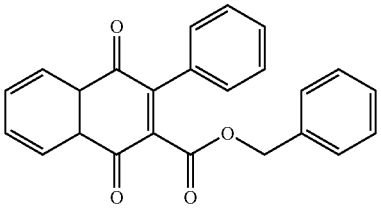

Comparative Production Example 3

-Preparation of Comparative Photoconductor 3-

A comparative photoconductor 3 was prepared in the same manner as in Production Example 1 with the exception that an electron transporting material represented by the following Structural Formula (E) was used in place of an electron transporting material represented by the Structural Formula (1) used as a photosensitive layer coating solution.

Structural Formula (E)

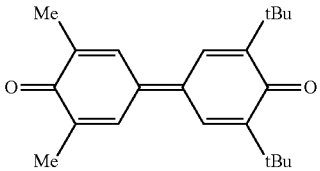

In the Structural Formula (E), Me represents a methyl group, t-Bu represents a t-butyl group.

Comparative Production Example 4

-Preparation of Comparative Photoconductor 4-

A comparative photoconductor 4 was prepared in the same manner as in Production Example 1 with the exception that titanyl phthalocyanine (ELA3847) manufactured by H. W. Sand Inc. was used in place of titanyl phthalocyanine powder having a maximum peak of at least 27.2°±0.2° of the Bragg angle 2θ with respect to characteristic X-rays of Cu-Kα (wavelength of 1.542 Å) and a peak at 7.3°±0.2° on the lowest angle side but not having a peak between the peak of 7.3° and that of 9.4° or a peak at 26.3°, which is used as a charge generating material.

Comparative Production Example 5

-Preparation of Comparative Photoconductor 5-

A comparative photoconductor 5 was prepared in the same manner as in Production Example 1 with the exception that the X-metal free phthalocyanine was not used as a charge generating material.

Comparative Production Example 6

-Preparation of Comparative Photoconductor 6-

A comparative photoconductor 6 was prepared in the same manner as in Production Example 1 with the exception that only the X-metal free phthalocyanine was used as a charge generating material.

Examples 1 to 19 and Comparative Examples 1 to 6

Then, photoconductors 1 to 19 and comparative photoconductors 1 to 6 were respectively prepared for practical use, and then mounted on an image forming apparatus in which a power pack was remodeled based on a digital multi-function device (IMAGIO MF7070, manufactured by Ricoh Company Ltd.) equipped with a cleaning brush and a cleaning blade as a rubbing member of photoconductor and the toner was also changed in polarity so as to be positively charged. The thus remodeled image forming apparatus was used to print out 250,000 sheets of an A4 size test chart having a 6% image area ratio of continuously up to 250,000 sheets of A4 size (long edge feed) in a continuous manner.

The following items on images printed at the initial stage as well as after printing of 50,000 and 250,000 sheets using the respective photoconductors were evaluated. Tables 1-A and 1-B show the evaluation results.

<Decrease in Charged Electric Potential of Photoconductor and Electric Potential at Exposed Region>

The applied voltage of the charging device (charger) was adjusted so that the electric potential on the surface of the respective photoconductors at the time of charging (electric potential at dark space) could be +800V at the start of printing (initial stage) and, with the applied voltage kept at the same level thereafter, and then a decrease in charged electric potential on the surface of photoconductors (electric potential at dark space) ΔV (V) and an electric potential at the exposed region on the developing unit at the time of writing an entirely black solid image (V) after printing of 50,000 and 250,000 sheets were measured for evaluation.

<Evaluation of Afterimage>

The presence or absence of afterimage was evaluated, which were found on images output at the initial stage as well as after printing of 50,000 and 250,000 sheets.

<Total Evaluation of Image Quality>

Images output at an initial stage as well as after printing of 50,000 and 250,000 sheets were comprehensively evaluated as to the quality of images other than afterimages, such as change in image concentration at black solid parts, the presence or absence of blurred characters and the presence or absence of image deletion, in other words, the quality of images in every respect including the occurrence of afterimage.

TABLE 1-A

| | At initial stage of printing | | | After printing 50,000 sheets | | | | After printing 250,000 sheets | | | |
|---|---|---|---|---|---|---|---|---|---|---|---|
| | Electric potential (V) at exposed region | Afterimage | Total evaluation of image quality | Reduced amount of charged electric potential ΔV (V) | Electric potential (V) at exposed region | Afterimage | Total evaluation of image quality | Reduced amount of charged electric potential ΔV (V) | Electric potential (V) at exposed region | Afterimage | Total evaluation of image quality |
| Ex. 1 | 130 | Not occurred | Favorable | 30 | 140 | Not occurred | Favorable | 45 | 145 | Not occurred | Favorable |
| Ex. 2 | 90 | Not occurred | Favorable | 45 | 115 | Not occurred | Favorable | 60 | 130 | Not occurred | Favorable |
| Ex. 3 | 110 | Not occurred | Favorable | 40 | 120 | Not occurred | Favorable | 55 | 130 | Not occurred | Favorable |
| Ex. 4 | 125 | Not occurred | Favorable | 30 | 140 | Not occurred | Favorable | 45 | 150 | Not occurred | Favorable |
| Ex. 5 | 140 | Not occurred | Favorable | 30 | 150 | Not occurred | Favorable | 45 | 160 | Not occurred | Favorable |
| Ex. 6 | 150 | Not occurred | Favorable | 25 | 160 | Not occurred | Favorable | 40 | 170 | Not occurred | Favorable |
| Ex. 7 | 155 | Not occurred | Favorable | 20 | 165 | Not occurred | Favorable | 20 | 170 | Not occurred | Favorable |
| Ex. 8 | 160 | Not occurred | Favorable | 10 | 170 | Not occurred | Favorable | 15 | 180 | Not occurred | Favorable |
| Ex. 9 | 165 | Not occurred | Favorable | 10 | 175 | Not occurred | Favorable | 10 | 185 | Not occurred | Favorable |
| Ex. 10 | 155 | Not occurred | Favorable | 35 | 165 | Not occurred | Favorable | 45 | 180 | Not occurred | Favorable |
| Ex. 11 | 130 | Not occurred | Favorable | 30 | 140 | Not occurred | Favorable | 45 | 155 | Not occurred | Favorable |
| Ex. 12 | 120 | Not occurred | Favorable | 25 | 130 | Not occurred | Favorable | 40 | 140 | Not occurred | Favorable |
| Ex. 13 | 140 | Not occurred | Favorable | 30 | 145 | Not occurred | Favorable | 45 | 155 | Not occurred | Favorable |
| Ex. 14 | 125 | Not occurred | Favorable | 30 | 135 | Not occurred | Favorable | 45 | 150 | Not occurred | Favorable |
| Ex. 15 | 130 | Not occurred | Favorable | 35 | 140 | Not occurred | Favorable | 50 | 150 | Not occurred | Favorable |
| Ex. 16 | 140 | Not occurred | Favorable | 30 | 150 | Not occurred | Favorable | 45 | 155 | Not occurred | Favorable |
| Ex. 17 | 140 | Not occurred | Favorable | 40 | 155 | Not occurred | Favorable | 55 | 165 | Not occurred | Favorable |
| Ex. 18 | 165 | Not occurred | Favorable | 50 | 175 | Not occurred | Favorable | 65 | 180 | Not occurred | Favorable |
| Ex. 19 | 140 | Not occurred | Favorable | 30 | 150 | Not occurred | Favorable | 50 | 160 | Not occurred | Favorable |

TABLE 1-B

| | At initial stage of printing | | | After printing 50,000 sheets | | | | After printing 250,000 sheets | | | |
|---|---|---|---|---|---|---|---|---|---|---|---|
| | Electric potential (V) at exposed region | After-image | Total evaluation of image quality | Reduced amount of charged electric potential ΔV (V) | Electric potential (V) at exposed region | After-image | Total evaluation of image quality | Reduced amount of charged electric potential ΔV (V) | Electric potential (V) at exposed region | Afterimage | Total evaluation of image quality |
| Compara. Ex. 1 | 250 | Not occurred | Image density degraded | 20 | 260 | Not occurred | Image density degraded | 30 | 310 | Occurred | Image density degraded |
| Compara. Ex. 2 | 180 | Not occurred | Favorable | 40 | 190 | Not occurred | Image density degraded | 50 | 250 | Not occurred | Image density degraded |

TABLE 1-B-continued

| | At initial stage of printing | | | After printing 50,000 sheets | | | | After printing 250,000 sheets | | | |
|---|---|---|---|---|---|---|---|---|---|---|---|
| | Electric potential (V) at exposed region | After-image | Total evaluation of image quality | Reduced amount of charged electric potential ΔV (V) | Electric potential (V) at exposed region | After-image | Total evaluation of image quality | Reduced amount of charged electric potential ΔV (V) | Electric potential (V) at exposed region | Afterimage | Total evaluation of image quality |
| Compara. Ex. 3 | 190 | Not occurred | Favorable | 50 | 200 | Not occurred | Image density degraded | 70 | 280 | Occurred | Image density degraded |
| Compara. Ex. 4 | 250 | Occurred | Image density degraded | 20 | 260 | Occurred | Afterimage was conspicuous | 100 | 270 | Occurred | Afterimage was conspicuous |
| Compara. Ex. 5 | 90 | Not occurred | Favorable | 50 | 100 | Not occurred | Favorable | 120 | 110 | Slightly occurred | Background smear was observed |
| Compara. Ex. 6 | 280 | Not occurred | Image density degraded | 10 | 290 | Slightly occurred | Favorable | 15 | 300 | Not occurred | Image density degraded |

Production Examples 20 to 38 and Comparative Production Examples 7 to 12

-Preparation of Photoconductors 20 to 38 and Comparative Photoconductors 7 to 12-

Photoconductors 20 to 38 and comparative photoconductors 7 to 12 were prepared in the same manner as respectively in Production Examples 1 to 19 and Comparative Production Examples 1 to 6 with the exception that a 30 mm-across 256 mm-long aluminum drum was used in place of a 100 mm-across 360 mm-long aluminum drum.

Examples 20 to 38 and Comparative Examples 7 to 12

The thus prepared photoconductors 20 to 38 and the comparative photoconductors 7 to 12 were prepared for practical use and then mounted on an image forming apparatus in which a light source for exposure was changed from a laser diode with a wavelength of 655 nm to that with a wavelength of 780 nm, a power pack was remodeled based on a full-color printer (IPSIO CX400, manufactured by Ricoh Company Ltd.) equipped with a tandem mechanism composed of a plurality of photoconductor cartridges having a cleaning blade rubbing a plurality of photoconductors, and intermediate transfer belts by which a full color image was formed, and the toner was also changed in polarity so as to be positively charged.

The thus remodeled image forming apparatus was used to print out 50,000 sheets of an A4 size test chart (short edge feed) so that colors of black, cyan, magenta and yellow respectively were developed at an image ratio of 5%.

The presence or absence of afterimage on images printed at the initial stage as well as after printing of 10,000 and 50,000 sheets using the respective photoconductors were evaluated. Tables 2-A and 2-B show the evaluation results.

<Decrease in Charged Electric Potential of Photoconductor and Electric Potential at Exposed Region>

The applied voltage of the charging device (charge roller) was adjusted so that the electric potential on the surface of the respective photoconductors at the time of charging (electric potential at dark space) could be +550V at the start of printing (initial stage) and, with the applied voltage kept at the same level thereafter, and then a decrease in charged electric potential on the surface of photoconductors (electric potential at dark space) ΔV (V) and an electric potential at the exposed region on the developing unit at the time of writing an entirely black solid image (V) after printing of 10,000 and 50,000 sheets were measured for evaluation.

<Evaluation of Afterimage>

The presence or absence of afterimage was evaluated, which were found on images output at the initial stage as well as after printing of 10,000 and 50,000 sheets.

<Total Evaluation of Image Quality>

Images output at an initial stage as well as after printing of 10,000 and 50,000 sheets were comprehensively evaluated as to the quality of images other than afterimages, such as change in image concentration at black solid parts, the presence or absence of blurred characters and the presence or absence of image deletion, in other words, the quality of images in every respect including the occurrence of afterimage.

TABLE 2-A

| | At initial stage of printing | | | After printing 10,000 sheets | | | | After printing 50,000 sheets | | | |
|---|---|---|---|---|---|---|---|---|---|---|---|
| | Electric potential (V) at exposed region | Afterimage | Total evaluation of image quality | Reduced amount of charged electric potential ΔV (V) | Electric potential (V) at exposed region | Afterimage | Total evaluation of image quality | Reduced amount of charged electric potential ΔV (V) | Electric potential (V) at exposed region | Afterimage | Total evaluation of image quality |
| Ex. 20 | 60 | Not occurred | Favorable | 20 | 70 | Not occurred | Favorable | 35 | 80 | Not occurred | Favorable |
| Ex. 21 | 35 | Not occurred | Favorable | 25 | 45 | Not occurred | Favorable | 40 | 55 | Not occurred | Favorable |
| Ex. 22 | 50 | Not occurred | Favorable | 30 | 60 | Not occurred | Favorable | 45 | 70 | Not occurred | Favorable |
| Ex. 23 | 60 | Not occurred | Favorable | 25 | 70 | Not occurred | Favorable | 40 | 80 | Not occurred | Favorable |
| Ex. 24 | 65 | Not occurred | Favorable | 25 | 75 | Not occurred | Favorable | 40 | 85 | Not occurred | Favorable |
| Ex. 25 | 70 | Not occurred | Favorable | 20 | 80 | Not occurred | Favorable | 35 | 90 | Not occurred | Favorable |
| Ex. 26 | 75 | Not occurred | Favorable | 20 | 85 | Not occurred | Favorable | 35 | 95 | Not occurred | Favorable |
| Ex. 27 | 80 | Not occurred | Favorable | 15 | 90 | Not occurred | Favorable | 30 | 100 | Not occurred | Favorable |
| Ex. 28 | 95 | Not occurred | Favorable | 10 | 105 | Not occurred | Favorable | 25 | 115 | Not occurred | Favorable |
| Ex. 29 | 80 | Not occurred | Favorable | 30 | 90 | Not occurred | Favorable | 45 | 100 | Not occurred | Favorable |
| Ex. 30 | 70 | Not occurred | Favorable | 20 | 80 | Not occurred | Favorable | 35 | 90 | Not occurred | Favorable |
| Ex. 31 | 60 | Not occurred | Favorable | 30 | 70 | Not occurred | Favorable | 45 | 80 | Not occurred | Favorable |
| Ex. 32 | 80 | Not occurred | Favorable | 25 | 90 | Not occurred | Favorable | 40 | 100 | Not occurred | Favorable |
| Ex. 33 | 65 | Not occurred | Favorable | 30 | 75 | Not occurred | Favorable | 45 | 85 | Not occurred | Favorable |
| Ex. 34 | 70 | Not occurred | Favorable | 35 | 80 | Not occurred | Favorable | 50 | 90 | Not occurred | Favorable |
| Ex. 35 | 80 | Not occurred | Favorable | 30 | 90 | Not occurred | Favorable | 45 | 100 | Not occurred | Favorable |
| Ex. 36 | 80 | Not occurred | Favorable | 40 | 90 | Not occurred | Favorable | 55 | 100 | Not occurred | Favorable |
| Ex. 37 | 105 | Not occurred | Favorable | 45 | 115 | Not occurred | Favorable | 60 | 125 | Not occurred | Favorable |
| Ex. 38 | 80 | Not occurred | Favorable | 30 | 90 | Not occurred | Favorable | 45 | 100 | Not occurred | Favorable |

TABLE 2-B

| | At initial stage of printing | | | After printing 10,000 sheets | | | | After printing 400,000 sheets | | | |
|---|---|---|---|---|---|---|---|---|---|---|---|
| | Electric potential (V) at exposed region | After-image | Total evaluation of image quality | Reduced amount of charged electric potential ΔV (V) | Electric potential (V) at exposed region | After-image | Total evaluation of image quality | Reduced amount of charged electric potential ΔV (V) | Electric potential (V) at exposed region | Afterimage | Total evaluation of image quality |
| Comp. Ex. 7 | 190 | Not occurred | Image density degraded | 20 | 240 | Not occurred | Image density degraded | 35 | 250 | Occurred | Image density degraded |
| Com. Ex. 8 | 120 | Not occurred | Favorable | 40 | 130 | Not occurred | Image density degraded | 60 | 140 | Not occurred | Image density degraded |
| Comp. Ex. 9 | 130 | Not occurred | Favorable | 50 | 165 | Not occurred | Image density degraded | 65 | 175 | Occurred | Image density degraded |
| Comp. Ex. 10 | 190 | Occurred | Image density degraded | 40 | 225 | Occurred | Afterimage was conspicuous | 80 | 235 | Occurred | Afterimage was conspicuous |
| Comp. Ex. 11 | 30 | Not occurred | Favorable | 50 | 40 | Not occurred | Favorable | 100 | 50 | Slightly occurred | Background smear was observed |
| Comp. Ex. 12 | 220 | Not occurred | Image density degraded | 10 | 230 | Slightly occurred | Favorable | 25 | 240 | Not occurred | Image density degraded |

Since the image forming apparatus and the image forming method of the present invention are able to provide extremely high-quality full-color images, causing no change in color tone over the long time use and causing substantially no abnormal images such as decrease in image density and background smear, they are highly practically valuable when used in a copier, a facsimile, a laser printer, a direct digital photoengraving machine and the like.

What is claimed is:

1. A process of producing a photoconductor, comprising:

preparing a photosensitive layer coating solution comprising a mixture of two charge generating material dispersions; wherein the mixture of two charge generating material dispersions are prepared by dispersing crystalline titanyl phthalocyanine in an appropriate solvent, dispersing X-metal free phthalocyanine in an appropriate solvent, and then mixing the two dispersions in a solution prepared by dissolving a binder resin, an electron transporting material and a positive-hole transporting substance;

coating a conductive substrate with the photosensitive layer coating solution to form a photosensitive layer; and drying the photosensitive layer;

wherein the photoconductor comprises at least a conductive substrate and a single-layered photosensitive layer over the conductive substrate, and the photosensitive layer contains at least a charge generating material, an electron transporting material, a positive-hole transporting substance and a binder resin; the charge generating material contains crystalline titanyl phthalocyanine having a maximum diffraction peak of at least 27.2° as a diffraction peak ±0.2° of the Bragg angle 2θ with respect to the Cu-Kα line of the wavelength of 1.542Å, further having major peaks at 9.4°, 9.6°, 24.0°, and also having a peak at 7.3° as a diffraction peak on the lowest angle side but not having a peak between the peak of 7.3° and that of 9.4°, and X-metal free phthalocyanine; and the electron transporting material contains a compound represented by the following General Formula (1), General Formula (1)

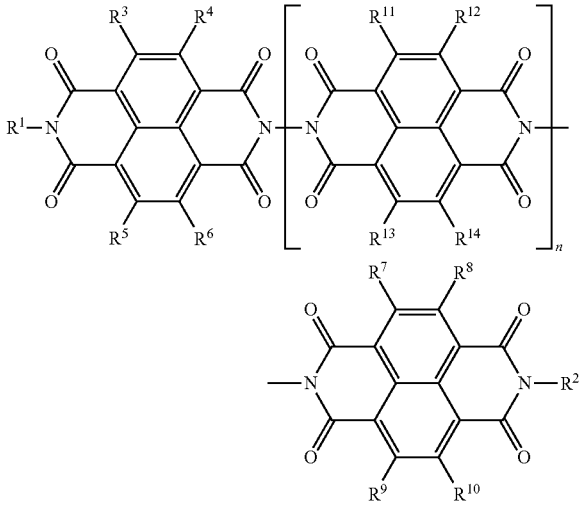

where, $R^1$ and $R^2$ may be the same or different from each other and each represent any one of a hydrogen atom, an alkyl group that may have a substituent group, a cycloalkyl group that may have a substituent group and an aralkyl group that may have a substituent group; $R^3$, $R^4$, $R^5$, $R^6$, $R^7$, $R^8$, $R^9$, $R^{10}$, $R^{11}$, $R^{12}$, $R^{13}$, and $R^{14}$ may be the same or different from each other and each represent any one of a hydrogen atom, a halogen atom, a cyano group, a nitro group, an amino group, a hydroxyl group, an alkyl group that may have a substituent group, a cycloalkyl group that may have a substituent group, and an aralkyl group that may have a substituent group; and "n" stands for the number of repeating units and is an integer of 0 to 100.

2. The process of producing a photoconductor according to claim 1, wherein the positive-hole transporting substance contains a compound represented by the following General Formula (i), General Formula (i)

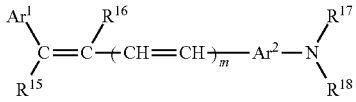

wherein $R^{15}$, $R^{16}$, $R^{17}$ and $R^{18}$ may be the same or different from each other and each represent any one of a hydrogen atom, an alkyl group that may have a substituent group and an aryl group that may have a substituent group; $Ar^1$ represents an aryl group that may have a substituent group; $Ar^2$ represents an arylene group that may have a substituent group; $Ar^1$ and $R^{15}$ may be combined to form a ring; and "m" is an integer of 0 or 1.

3. The process of producing a photoconductor according to claim 2, wherein the positive-hole transporting substance is present in the photosensitive layer in an amount from 10% by mass to 70% by mass with respect to a total solid content of the photosensitive layer.

4. The process of producing a photoconductor according to claim 1, wherein the binder resin has a polycarbonate structure.

5. The process of producing a photoconductor according to claim 1, further comprising, prior to coating the photosensitive layer coating solution on the conductive substrate, coating and drying an under layer coating solution on the conductive substrate to form an under layer between the photosensitive layer and the conductive substrate.

6. The process of producing a photoconductor according to claim 5, wherein the under layer has a thickness of from 0.1 μm to 10 μm.

7. The process of producing a photoconductor according to claim 1, wherein the photosensitive layer has a thickness of from 5 μm to 100 μm.

8. The process of producing a photoconductor according to claim 1, wherein a total content of the charge generating material in the photosensitive layer is from 0.3% by mass to 10% by mass.

9. The process of producing a photoconductor according to claim 1, wherein the X-metal free phthalocyanine is present in a proportion of up to 50% of the total charge generating material.

10. The process of producing a photoconductor according to claim 1, wherein the electron transporting material is at least one compound selected from the compounds of Structural Formulae (1)-(8):

Structural Formula (1)
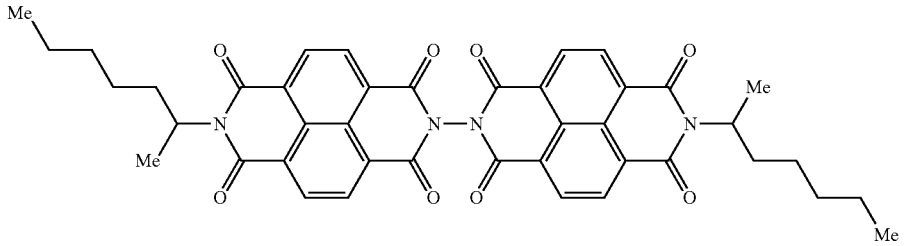
Structural Formula (2)
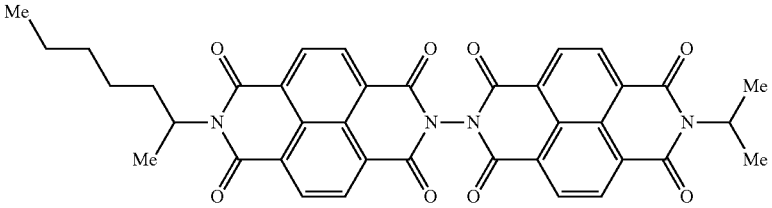
Structural Formula (3)
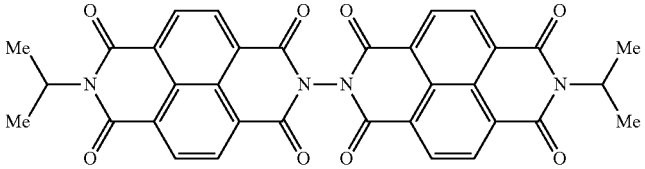
Structural Formula (4)
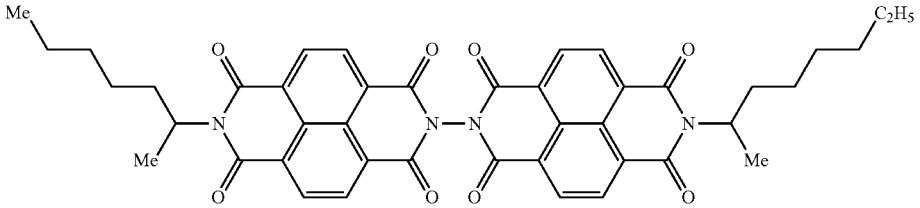
Structural Formula (5)
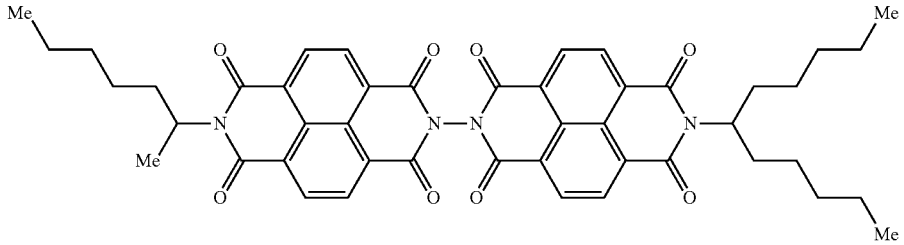
Structural Formula (6)
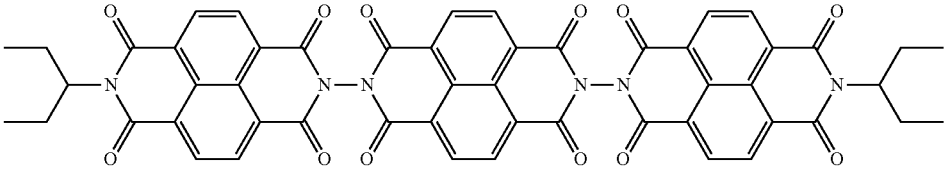
Structural Formula (7)
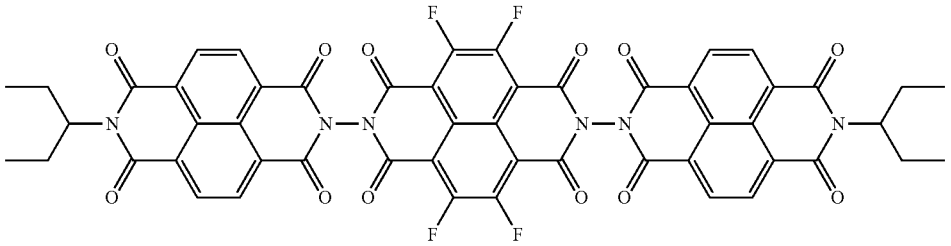
and -continued
Structural Formula (8)
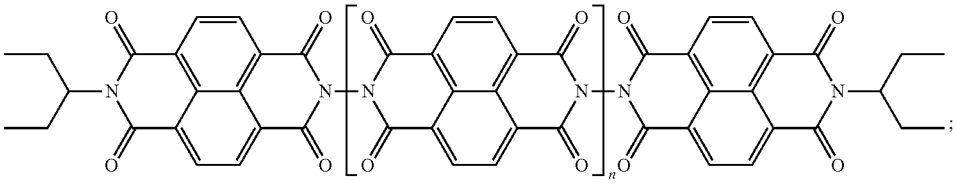
wherein in Structural Formula (8), n is an integer of 1 to 100.
* * * * *